US011148417B2

(12) United States Patent
Yoshida

(10) Patent No.: US 11,148,417 B2
(45) Date of Patent: Oct. 19, 2021

(54) LIQUID DISCHARGE APPARATUS, DRIVE WAVEFORM GENERATING DEVICE, AND HEAD DRIVING METHOD

(71) Applicant: Takahiro Yoshida, Kanagawa (JP)

(72) Inventor: Takahiro Yoshida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/916,773

(22) Filed: Jun. 30, 2020

(65) Prior Publication Data

US 2021/0001629 A1 Jan. 7, 2021

(30) Foreign Application Priority Data

Jul. 3, 2019 (JP) ..... JP2019-124829
Jun. 25, 2020 (JP) ..... JP2020-109264

(51) Int. Cl.
*B41J 2/045* (2006.01)
*B41J 2/155* (2006.01)

(52) U.S. Cl.
CPC ..... *B41J 2/04596* (2013.01); *B41J 2/04541* (2013.01); *B41J 2/04581* (2013.01); *B41J 2/155* (2013.01); *B41J 2202/21* (2013.01)

(58) Field of Classification Search
CPC ..... B41J 2/155; B41J 2/04581; B41J 2/04588
See application file for complete search history.

(56) References Cited

U.S. PATENT DOCUMENTS 6,502,914 B2 * 1/2003 Hosono ..... B41J 2/04581 347/11
6,685,293 B2 * 2/2004 Junhua ..... B41J 2/04581 347/11
10,780,691 B2 * 9/2020 Sohgawa ..... B41J 2/04596
2007/0080978 A1 4/2007 Yoshida
2007/0211092 A1 9/2007 Shingyohuchi et al.
2009/0147034 A1 6/2009 Yoshida
2009/0289975 A1 11/2009 Yoshida
2011/0084996 A1 * 4/2011 Hirato ..... B41J 2/155 347/10

(Continued)

FOREIGN PATENT DOCUMENTS

JP 2002-326357 11/2002
JP 2012-192710 10/2012

*Primary Examiner* — Lam S Nguyen
(74) *Attorney, Agent, or Firm* — Harness, Dickey & Pierce, P.L.C.

(57) ABSTRACT

A liquid discharge apparatus includes a liquid discharge head to discharge liquid and control circuitry to generate a drive waveform including drive pulses applied to the head. The drive waveform includes a non-discharge pulse not to discharge the liquid and a discharge pulse to discharge the liquid. The non-discharge pulse and the discharge pulse are serial in time in the drive waveform. Td is in a range of Tc−0.2×Tc to Tc+0.45×Tc. Vp1 is in a range of −10% to +10% of Vpp1. Td represents a time interval between the non-discharge pulse and the discharge pulse. Tc represents a natural vibration period of a pressure chamber of the head. Vp1 represents a peak value of the non-discharge pulse. Vpp1 represents a peak value of the non-discharge pulse at which a droplet speed of liquid discharged by the discharge pulse takes a local minimum value.

9 Claims, 21 Drawing Sheets

(56) References Cited

U.S. PATENT DOCUMENTS

| | | | | |
|---|---|---|---|---|
| 2012/0236052 | A1 | 9/2012 | Tobita et al. | |
| 2013/0083106 | A1* | 4/2013 | Tsukamoto ..... | B41J 2/04596 347/10 |
| 2014/0218428 | A1 | 8/2014 | Araki et al. | |
| 2014/0285554 | A1 | 9/2014 | Yanaka et al. | |
| 2015/0375504 | A1 | 12/2015 | Mori et al. | |
| 2019/0283414 | A1 | 9/2019 | Yoshida | |

* cited by examiner

LIQUID DISCHARGE APPARATUS, DRIVE WAVEFORM GENERATING DEVICE, AND HEAD DRIVING METHOD

CROSS-REFERENCE TO RELATED APPLICATION

This patent application is based on and claims priority pursuant to 35 U.S.C. § 119(a) to Japanese Patent Application Nos. 2019-124829, filed on Jul. 3, 2019, and 2020-109264, filed on Jun. 25, 2020, in the Japan Patent Office, the entire disclosure of each of which is incorporated by reference herein.

BACKGROUND

Technical Field

Aspects of the present disclosure relate to a liquid discharge apparatus, a drive waveform generating device, and a head driving method.

Related Art

When liquid is discharged from a liquid discharge head, it is necessary to restrain satellite droplets caused by tailing of main droplets discharged from the liquid discharge head.

For example, there is known a driving waveform in which a satellite shortening waveform for increasing the speed of satellite droplets to shorten the tailing of a main droplet is arranged in a subsequent stage of a contraction waveform element of a drive pulse for discharging the main droplet.

SUMMARY

In an aspect of the present disclosure, there is provided a liquid discharge apparatus that includes a liquid discharge head configured to discharge liquid and control circuitry configured to generate a drive waveform including a plurality of drive pulses applied to the liquid discharge head. The drive waveform includes a non-discharge pulse not to discharge the liquid and a discharge pulse to discharge the liquid. The non-discharge pulse and the discharge pulse are serial in time in the drive waveform. Td is in a range of $Tc-0.2\times Tc$ to $Tc+0.45\times Tc$, and Vp1 is in a range of −10% to +10% of Vpp1, where Td represents a time interval between the non-discharge pulse and the discharge pulse, Tc represents a natural vibration period of a pressure chamber of the liquid discharge head, Vp1 represents a peak value of the non-discharge pulse, and Vpp1 represents a peak value of the non-discharge pulse at which a droplet speed of liquid discharged by the discharge pulse takes a local minimum value.

In another aspect of the present disclosure, there is provided a drive waveform generating device that includes a liquid discharge head configured to discharge liquid and control circuitry configured to generate a drive waveform including a plurality of drive pulses applied to the liquid discharge head. The drive waveform includes a non-discharge pulse not to discharge the liquid and a discharge pulse to discharge the liquid. The non-discharge pulse and the discharge pulse are serial in time in the drive waveform. Td is in a range of $Tc-0.2\times Tc$ to $Tc+0.45\times Tc$, and Vp1 is in a range of −10% to +10% of Vpp1, where Td represents a time interval between the non-discharge pulse and the discharge pulse, Tc represents a natural vibration period of a pressure chamber of the liquid discharge head, Vp1 represents a peak value of the non-discharge pulse, and Vpp1 represents a peak value of the non-discharge pulse at which a droplet speed of liquid discharged by the discharge pulse takes a local minimum value.

In still another aspect of the present disclosure, there is provided a head driving method of driving a liquid discharge head. The method includes generating a drive waveform including a plurality of drive pulses applied to the liquid discharge head; and applying the drive waveform to the liquid discharge head to discharge liquid. The drive waveform includes a non-discharge pulse not to discharge the liquid and a discharge pulse to discharge the liquid. The non-discharge pulse and the discharge pulse are serial in time in the drive waveform. Td is in a range of $Tc-0.2\times Tc$ to $Tc+0.45\times Tc$, and Vp1 is in a range of −10% to +10% of Vpp1, where Td represents a time interval between the non-discharge pulse and the discharge pulse, Tc represents a natural vibration period of a pressure chamber of the liquid discharge head, Vp1 represents a peak value of the non-discharge pulse, and Vpp1 represents a peak value of the non-discharge pulse at which a droplet speed of liquid discharged by the discharge pulse takes a local minimum value.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
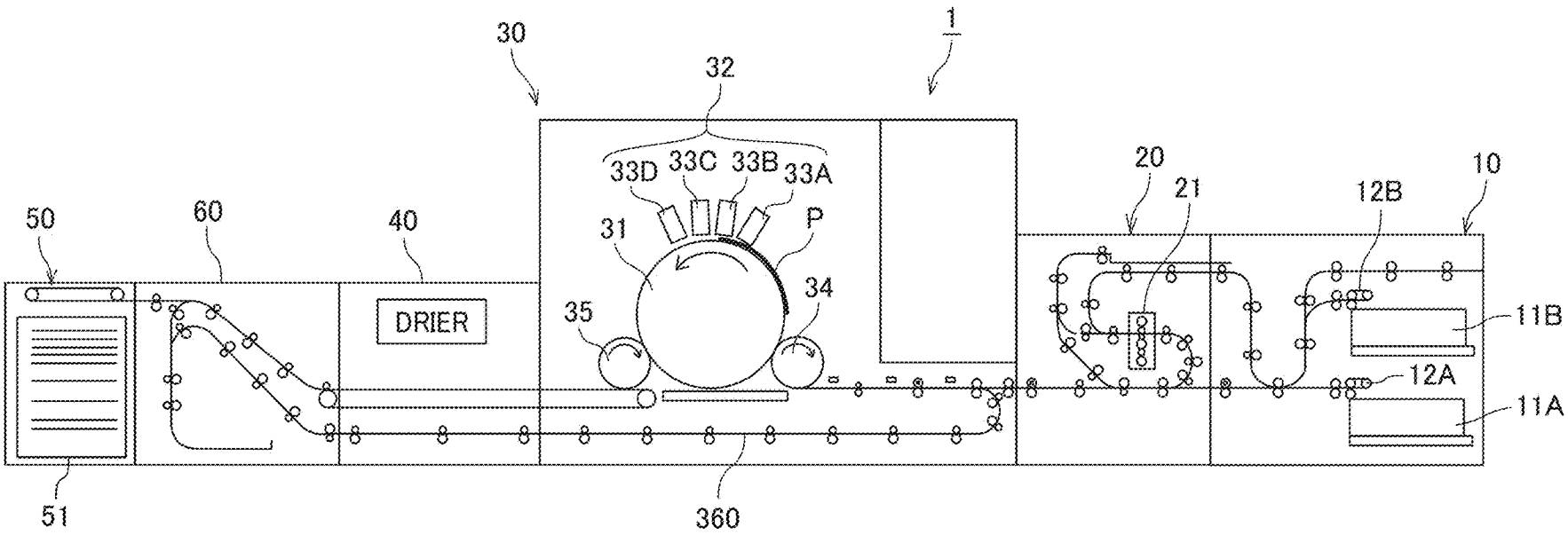
FIG. 1 is a schematic view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results. As used herein, the singular forms "a", "an", and "the" are intended to include the plural forms as well, unless the context clearly indicates otherwise.

Although the embodiments are described with technical limitations with reference to the attached drawings, such description is not intended to limit the scope of the disclosure and all of the components or elements described in the embodiments of this disclosure are not necessarily indispensable.

Figure 2:
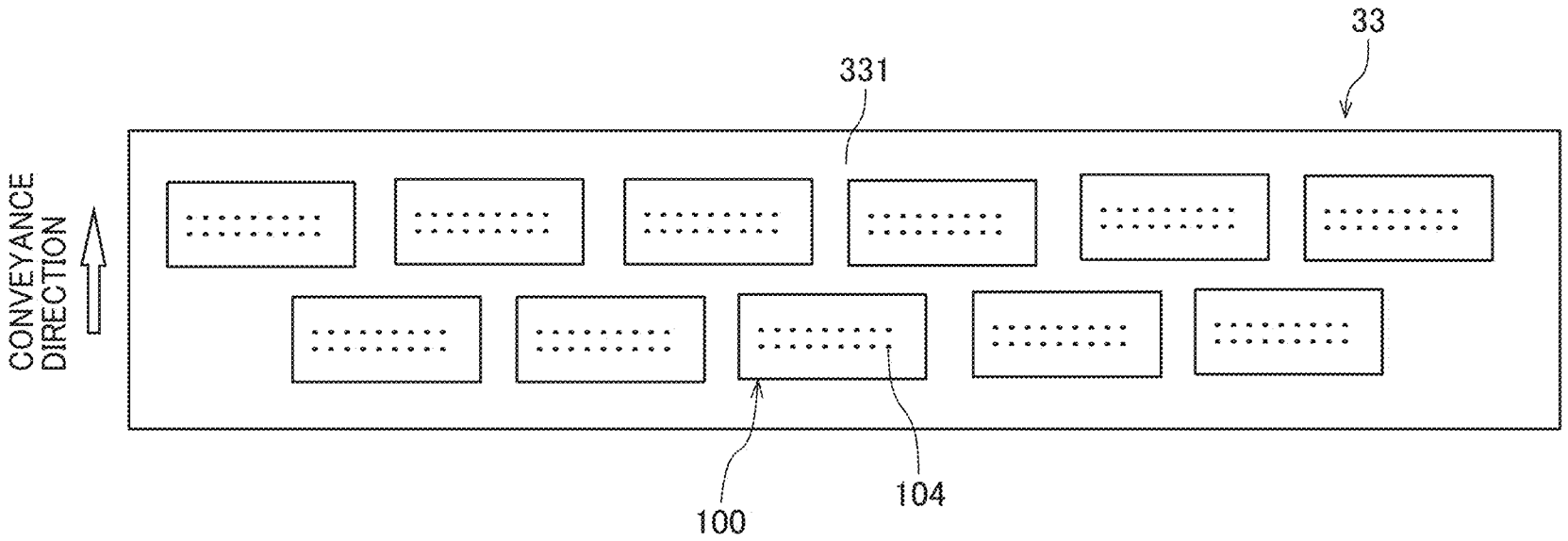
FIG. 2 is a plan view of a discharge unit of the printer.

Below, embodiments of the present disclosure are described with reference to the accompanying drawings. A printer as a liquid discharge apparatus according to a first embodiment of the present disclosure is described with reference to FIGS. 1 and 2. FIG. 1 is a schematic view of the printer. FIG. 2 is a plan view of a discharge unit of the printer.

A printer 1 is a liquid discharge apparatus according to the present embodiment and includes a loading unit 10 to load a sheet P into the printer 1, a pretreatment unit 20, a printing unit 30, a drying unit 40, and an unloading unit 50. In the printer 1, the pretreatment unit 20 applies, as required, pretreatment liquid onto the sheet P fed (supplied) from the loading unit 10, the printing unit 30 applies liquid to the sheet P to perform printing, the drying unit 40 dries the liquid adhering to the sheet P, and the sheet P is ejected to the unloading unit 50.

The loading unit 10 includes loading trays 11 (a lower loading tray 11A and an upper loading tray 11B) to accommodate a plurality of sheets P and feeding devices 12 (a feeding device 12A and a feeding device 12B) to separate and feed the sheets P one by one from the loading trays 11, and supplies the sheets P to the pretreatment unit 20.

The pretreatment unit 20 includes, e.g., a coater 21 as a treatment-liquid applying device that coats an image formation surface of a sheet P with a treatment liquid having an effect of aggregating ink particles to prevent bleed-through.

The printing unit 30 includes a drum 31 and a liquid discharge device 32. The drum 31 is a bearer (rotating member) that bears the sheet P on a circumferential surface of the drum 31 and rotates. The liquid discharge device 32 discharges liquid toward the sheet P borne on the drum 31.

The printing unit 30 includes transfer cylinders 34 and 35. The transfer cylinder 34 receives the sheet P from the pretreatment unit 20 and forwards the sheet P to the drum 31. The transfer cylinder 35 receives the sheet P conveyed by the drum 31 and forwards the sheet P to the drying unit 40.

The transfer cylinder 34 includes a sheet gripper to grip the leading end of the sheet P conveyed from the pretreatment unit 20 to the printing unit 30. The sheet P thus gripped is conveyed as the transfer cylinder 34 rotates. The transfer cylinder 34 forwards the sheet P to the drum 31 at a position opposite the drum 31.

Similarly, the drum 31 includes a sheet gripper on the surface thereof, and the leading end of the sheet P is gripped by the sheet gripper. The drum 31 has a plurality of suction holes dispersedly on the surface thereof, and a suction device generates suction airflows directed inward from suction holes of the drum 31.

On the drum 31, the sheet gripper grips the leading end of the sheet P forwarded from the transfer cylinder 34, and the sheet P is attracted to and borne on the drum 31 by the suction airflows by the suction device. As the drum 31 rotates, the sheet P is conveyed.

The liquid discharge device 32 includes discharge units 33 (discharge units 33A to 33D) to discharge liquids. For example, the discharge unit 33A discharges a liquid of cyan (C), the discharge unit 33B discharges a liquid of magenta (M), the discharge unit 33C discharges a liquid of yellow (Y), and the discharge unit 33D discharges a liquid of black (K). In addition, a discharge unit to discharge a special liquid, that is, a liquid of spot color such as white, gold, or silver, can be used.

The discharge unit 33 is a full line head and includes a plurality of liquid discharge heads 100 (hereinafter simply referred to as "heads 100") arranged in a staggered manner on a base 331. Each of the liquid discharge head 100 includes a plurality of nozzle rows and a plurality of nozzles 104 is arranged in each of the nozzle rows, for example, as illustrated in FIG. 2.

The discharge operation of each of the discharge units 33 of the liquid discharge device 32 is controlled by a drive signal corresponding to print data. When the sheet P borne on the drum 31 passes through a region facing the liquid discharge device 32, the respective color liquids are discharged from the discharge units 33, and an image corresponding to the print data is formed.

The drying unit 40 dries the liquid applied onto the sheet P by the printing unit 30. As a result, a liquid component such as moisture in the liquid evaporates, and the colorant contained in the liquid is fixed on the sheet P. Additionally, curling of the sheet P is restrained.

The reversing unit 60 reverses, in switchback manner, the sheet P that has passed through the drying unit 40 in double-sided printing. The reversed sheet P is fed back to the upstream side of the transfer cylinder 34 through a conveyance passage 61 of the printing unit 30.

The unloading unit 50 includes an unloading tray 51 on which a plurality of sheets P is stacked. The plurality of sheets P conveyed through the reversing unit 60 from the drying unit 40 is sequentially stacked and held on the unloading tray 51.

Figure 3:
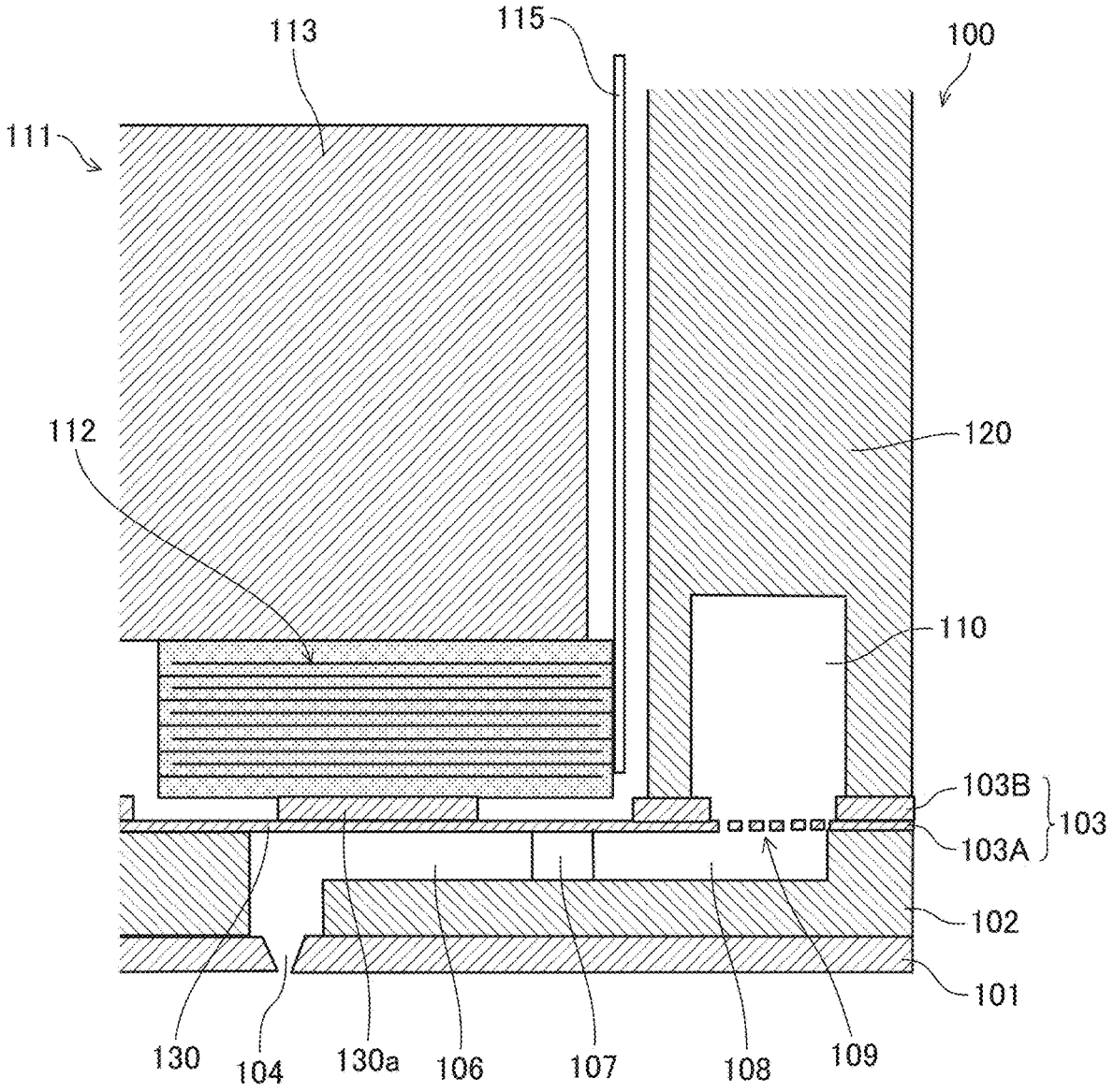
FIG. 3 is a cross-sectional view of an example of a liquid discharge head (also simply referred to as head) taken along a direction orthogonal to a nozzle array direction of the head.
Figure 4:
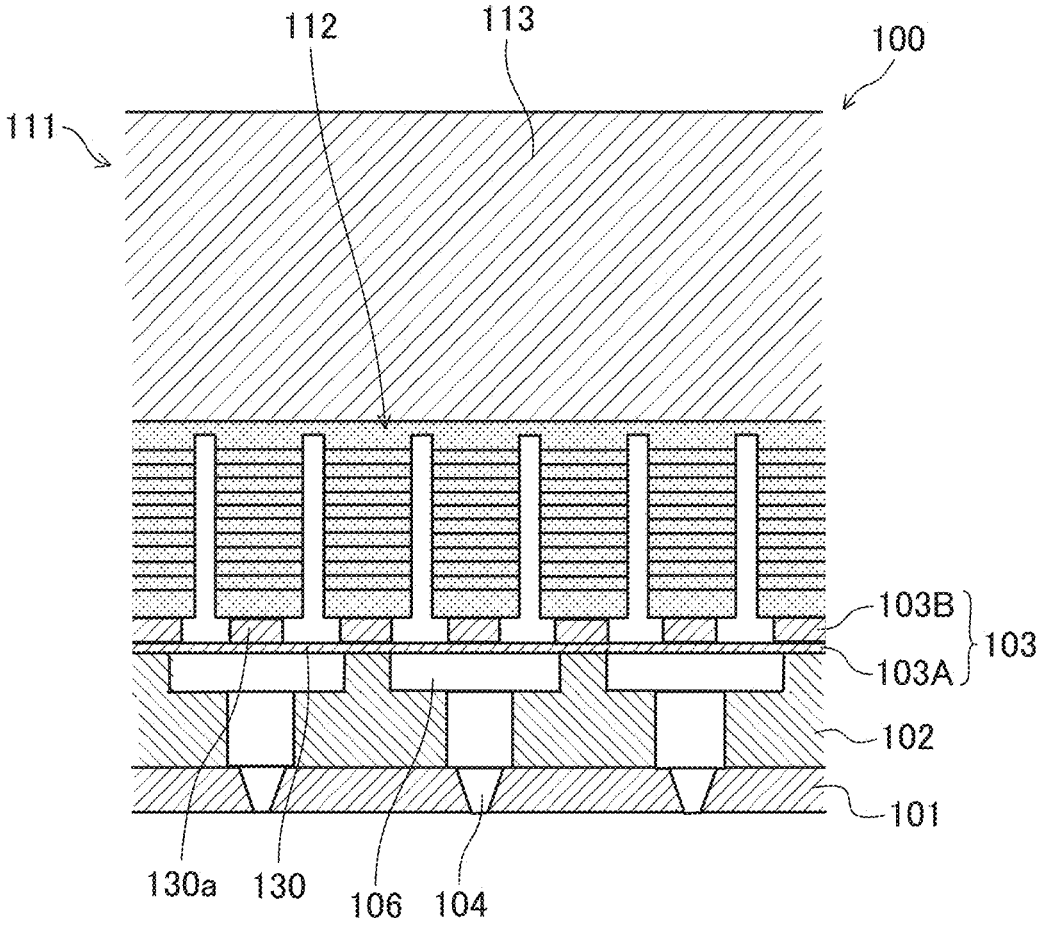
FIG. 4 is a cross-sectional view of the head taken along the nozzle array direction.

Next, an example of the head 100 is described with reference to FIGS. 3 and 4. FIG. 3 is a cross sectional view of the liquid discharge head, taken along a direction perpendicular to a nozzle array direction. FIG. 4 is a cross sectional view of the liquid discharge head, taken along the nozzle array direction.

The liquid discharge head 100 according to the present embodiment includes a nozzle plate 101, a channel plate 102, and a diaphragm member 103 as a wall surface member that are stacked and bonded. The liquid discharge head 100 also includes a piezoelectric actuator 111 and a common channel member 120. The piezoelectric actuator 111 displaces a vibration region (diaphragm) 130 of the diaphragm member 103. The common channel member 120 also serves as a frame member of the liquid discharge head 100.

The nozzle plate 101 has a plurality of nozzle rows in each of which a plurality of nozzles 104 for discharging liquid are arranged.

The channel plate 102 forms a plurality of pressure chambers 106 communicating with the plurality of nozzles 104, a plurality of individual supply channels 107 also serving as fluid restrictors communicating with the respective pressure chambers 106, and a plurality of intermediate supply channels 108 each serving as a liquid introduction portion communicating with two or more of the individual supply channels 107.

The diaphragm member 103 includes a plurality of displaceable diaphragms (vibration regions) 130 forming wall surfaces of the pressure chambers 106 of the channel plate 102. Here, the diaphragm member 103 has a two-layer structure (but is not limited to the two-layer structure) and includes a first layer 103A forming a thin portion and a second layer 103B forming a thick portion in this order from a side facing the channel plate 102.

The displaceable vibration region 130 is formed in a portion corresponding to the pressure chamber 106 in the first layer 103A which is a thin portion. In the vibration region 130, a convex portion 130*a* is formed as a thick portion joined to the piezoelectric actuator 111 in the second layer 103B.

The piezoelectric actuator 111 including an electromechanical transducer serving as a driving device (an actuator device or a pressure generating element) to deform the vibration region 130 of the diaphragm member 103 is disposed on a side of the diaphragm member 103 opposite a side facing the pressure chamber 106.

In the piezoelectric actuator 111, a piezoelectric member bonded on the base 113 is grooved by half-cut dicing, to form a desired number of columnar piezoelectric elements 112 at predetermined intervals in a comb shape. Every other piezoelectric element 112 is bonded to the convex portion 130a that is an island-shaped thick portion in the vibration region 130 of the diaphragm member 103.

The piezoelectric element 112 includes piezoelectric layers and internal electrodes alternately laminated on each other. Each internal electrode is led out to an end surface and connected to an external electrode (end surface electrode). The external electrode is connected with a flexible wiring member 115.

The common channel member 120 forms a common supply channel 110. The common supply channel 110 communicates with the intermediate supply channel 108 serving as the liquid introduction portion via an opening portion 109 also serving as a filter portion provided in the diaphragm member 103 and communicates with the individual supply channels 107 via the intermediate supply channel 108.

In the liquid discharge head 100, for example, the voltage to be applied to the piezoelectric element 112 is lowered from a reference potential (intermediate potential) so that the piezoelectric element 112 contracts to pull the vibration region 130 of the diaphragm member 103 to increase the volume of the pressure chamber 106. As a result, liquid flows into the pressure chamber 106.

Then, the voltage to be applied to the piezoelectric element 112 is increased to expand the piezoelectric element 112 in the stacking direction, and the vibration region 130 of the diaphragm member 103 is deformed in a direction toward the nozzle 104 to reduce the volume of the pressure chamber 106. As a result, the liquid in the pressure chamber 106 is pressurized and discharged from the nozzle 104.

Figure 5:
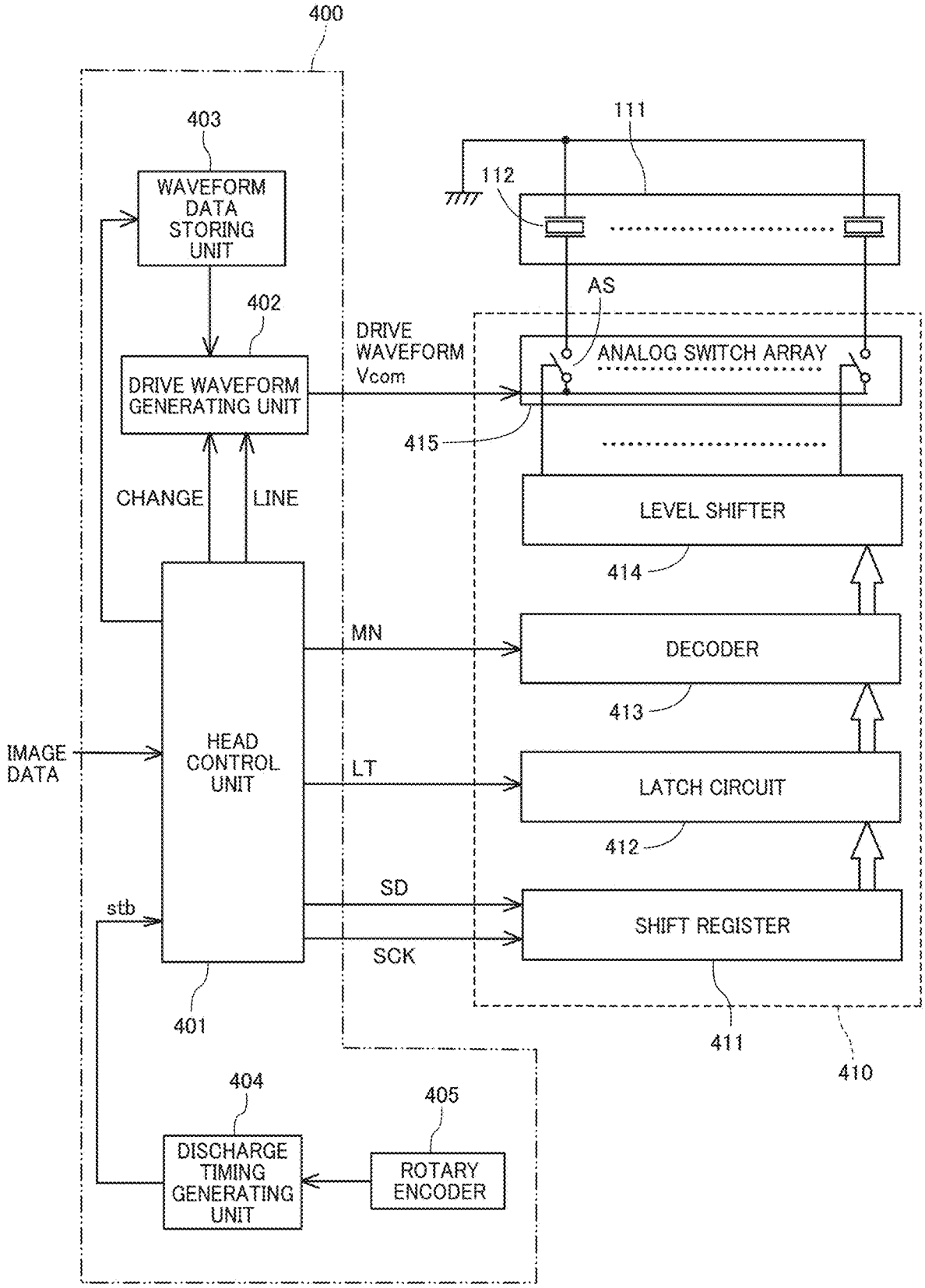
FIG. 5 is a block diagram of a head drive controller of the printer.

Next, a section related to a head drive control device that drives the head is described with reference to a block diagram of FIG. 5.

The head drive control device 400 that applies a drive waveform to the head 100 includes a head controller 401, a drive waveform generation unit 402 and a waveform data storage unit 403 that constitute a drive waveform generator, a head driver 410, and a discharge timing generation unit 404 to generate a discharge timing.

In response to a reception of a discharge timing pulse stb, the head controller 401 outputs a discharge synchronization signal LINE that triggers generation of the drive waveform, to the drive waveform generation unit 402. Further, the head controller 401 outputs a discharge timing signal CHANGE corresponding to the amount of delay from the discharge synchronization signal LINE, to the drive waveform generation unit 402.

The drive waveform generation unit 402 generates a common drive waveform signal Vcom at the timing based on the discharge synchronization signal LINE and the discharge timing signal CHANGE.

The head controller 401 receives image data and generates a mask control signal MN based on the image data. The mask control signal MN is for selecting a waveform of the common drive waveform signal Vcom according to the size of the liquid droplet to be discharged from each nozzle 104 of the head 100. The mask control signal MN is a signal at a timing synchronized with the discharge timing signal CHANGE.

The head controller 401 transmits image data SD, a synchronization clock signal SCK, a latch signal LT instructing latch of the image data, and the generated mask control signal MN to the head driver 410.

The head driver 410 includes a shift register 411, a latch circuit 412, a gradation decoder 413, a level shifter 414, and an analog switch array 415.

The shift register 411 receives the image data SD and the synchronization clock signal SCK transmitted from the head controller 401. The latch circuit 412 latches each value on the shift register 411 according to the latch signal LT transmitted from the head controller 401.

The gradation decoder 413 decodes the value (image data SD) latched by the latch circuit 412 and the mask control signal MN and outputs the result. The level shifter 414 performs level conversion of a logic level voltage signal of the gradation decoder 413 to a level at which the analog switch AS of the analog switch array 415 can operate.

The analog switch AS of the analog switch array 415 is turned on and off by the output received from the gradation decoder 413 via the level shifter 414. The analog switch AS is provided for each nozzle 104 of the head 100 and is connected to an individual electrode of the piezoelectric element 112 corresponding to each nozzle 104. In addition, to the analog switch AS, the common drive waveform signal Vcom from the drive waveform generation unit 402 is input. In addition, as described above, the timing of the mask control signal MN is synchronized with the timing of the common drive waveform signal Vcom Therefore, the analog switch AS is switched between on and off timely in accordance with the output from the gradation decoder 413 via the level shifter 414. With this operation, the drive pulse to be applied to the piezoelectric element 112 corresponding to each nozzle 104 is selected from the drive pulses constituting the common drive waveform signal Vcom. As a result, the size of the droplet discharged from the nozzle 104 is controlled.

The discharge timing generation unit 404 generates and outputs the discharge timing pulse stb each time the sheet P is moved by a predetermined amount, based on the detection result of a rotary encoder 405 that detects the rotation amount of the drum 31. The rotary encoder 405 includes an encoder wheel that rotates together with the drum 31 and an encoder sensor that reads a slit of the encoder wheel.

Figure 6:
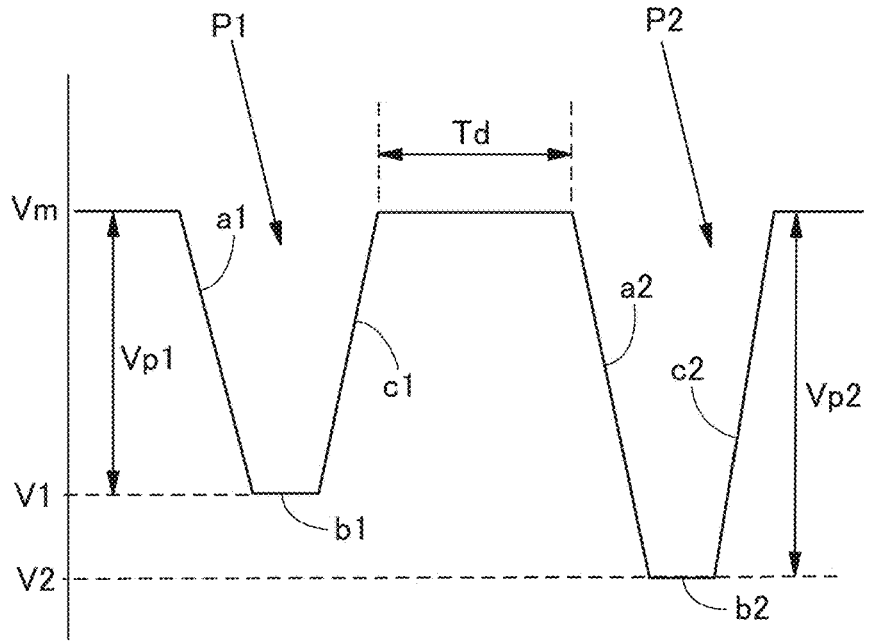
FIG. 6 is a graph illustrating a driving waveform in the first embodiment of the present disclosure.

Next, a drive waveform in the first embodiment of the present disclosure is described with reference to FIG. 6. FIG. 6 is a graph of an example of the drive wave form in the first embodiment.

The driving waveform Va according to the present embodiment includes a non-discharge pulse P1 for pressurizing the liquid in the pressure chamber 106 to such an extent that the liquid is not discharged and a discharge pulse P2 for pressurizing the liquid in the pressure chamber 106 to such an extent that the liquid is discharged. The non-discharge pulse P1 and the discharge pulse P2 are generated serially in time.

The non-discharge pulse P1 includes an expansion waveform element a1 for expanding the pressure chamber 106, a holding waveform element b1 for holding an expansion state of the pressure chamber 106 expanded by the expansion waveform element a1, and a contraction waveform element c1 for contracting the pressure chamber 106 from a state held by the holding waveform element b1.

The expansion waveform element a1 of the non-discharge pulse P1 is a waveform falling from an intermediate potential (or reference potential) Vm to a potential V1. The holding waveform element b1 is a waveform holding the potential V1. The contraction waveform element c1 is a waveform rising from the potential V1 to the intermediate potential Vm. The peak value of the non-discharge pulse P1 is Vp1.

The discharge pulse P2 includes an expansion waveform element a2 for expanding the pressure chamber 106, a holding waveform element b2 for holding an expansion state of the pressure chamber 106 expanded by the expansion waveform element a2, and a contraction waveform element c2 for contracting the pressure chamber 106 from a state held by the holding waveform element b2.

The expansion waveform element a2 of the discharge pulse P2 is a waveform falling from the intermediate potential (or reference potential) Vm to a potential V2. The holding waveform element b2 is a waveform holding the potential V2. The contraction waveform element c2 is a waveform rising from the potential V2 to the intermediate potential Vm. The peak value of the discharge pulse P2 is Vp2 (Vp2>Vp1).

The waveform from an end point of the contraction waveform element c1 of the non-discharge pulse P1 to a start point of the expansion waveform element a2 of the discharge pulse P2 is defined as an inter-pulse holding waveform element d. The time of the inter-pulse holding waveform element d (time interval between the non-discharge pulse P1 and the discharge pulse P2) is defined as Td.

Here, the time interval Td between the non-discharge pulse P1 and the discharge pulse P2 is set within a range of $-(1/3)\times Tc$ to $+(1/3)\times Tc$, where Tc is a natural vibration period (resonance period) of the pressure chamber 106 of the liquid discharge head 100.

The peak value Vp1 of the non-discharge pulse P1 is set within a range of −10% to +10% of a minimum value of a droplet speed Vj when the liquid is discharged by the discharge pulse P2.

As a result, satellites of droplets discharged by the discharge pulse P2 can be restrained.

Hereinafter, an operation and effect of the present embodiment will be described with reference to FIG. 7 and subsequent drawings.

Figure 7:
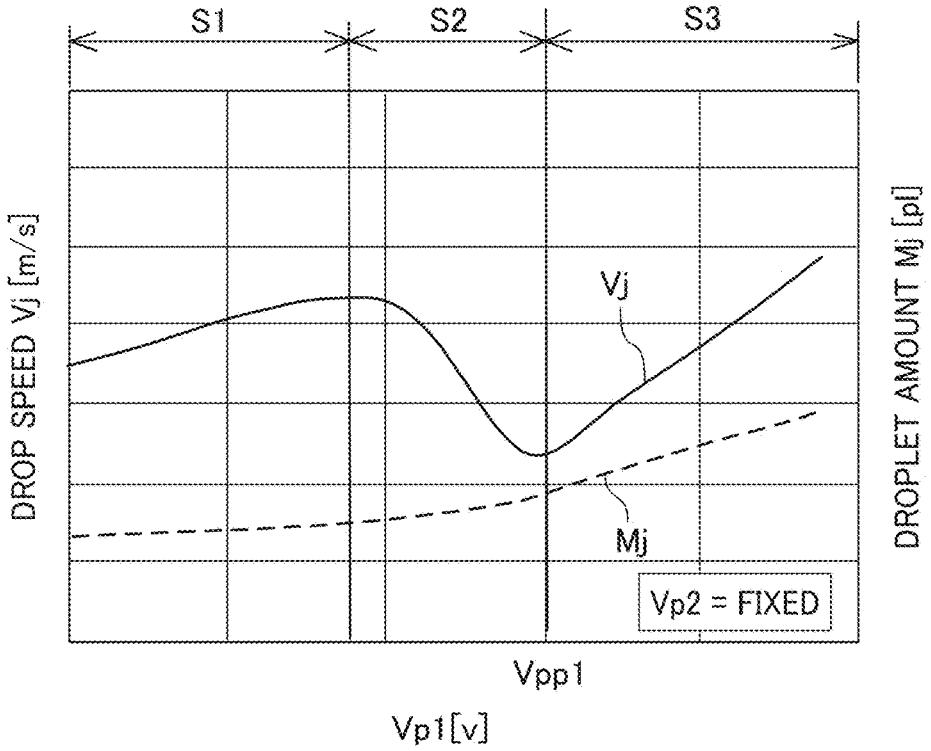
FIG. 7 is a graph illustrating an example of the relationship between peak value of non-discharge pulse, droplet speed, and droplet amount.

FIG. 7 illustrates an example of changes in the droplet speed Vj and the droplet amount Mj when the peak value Vp2 of the discharge pulse P2 is fixed and the peak value Vp1 of the non-discharge pulse P1 is changed. The time interval Td between the non-discharge pulse P1 and the discharge pulse P2 is the natural vibration period Tc.

From the result of FIG. 7, the range can be roughly divided into three ranges S1, S2, and S3 according to the value of the peak value Vp1.

That is, when the peak value Vp1 of the non-discharge pulse P1 is within the range S1, the droplet speed Vj increases as the peak value Vp1 increases. This indicates that as the peak value Vp1 of the non-discharge pulse P1 is increased, the meniscus vibration is also increased, and due to the influence thereof, the droplet speed Vj of the droplet by the discharge pulse P2 is increased.

When the peak value Vp1 of the non-discharge pulse P1 is within the range S2, the droplet speed Vj decreases from a local maximum value at the boundary between the range S1 and the range S2. This indicates a state in which the meniscus vibration becomes too large and exceeds the simple harmonic vibration of the meniscus, that is, a state in which the meniscus tends to overflow. Since the meniscus tends to overflow, the energy generated by the discharge pulse P2 is not efficiently transmitted, and the droplet speed Vj decreases.

When the peak value Vp1 of the non-discharge pulse P1 is within the range S3, the drop speed Vj increases from a local minimum value at the boundary between the range S2 and the range S3 (the peak value Vp1 at the boundary is set as the peaked peak value Vpp1).

It can also be seen that the drop amount Mj increases with a constant slope in the range S1 and the range S2, whereas the slope increases in the range S3. This indicates that the voltage of the peak value Vp1 of the non-discharge pulse P1 becomes too large and the droplet starts to be discharged even by the non-discharge pulse P1 itself (in this case, the non-discharge pulse P1 is substantially the discharge pulse).

That is, since the droplet is discharged by the non-discharge pulse P1, the discharge pulse P2 is discharged by normal resonance. The droplet speed Vj increases as the peak value Vp1 increases. At the same time, since both the droplet from the non-discharge pulse P1 and the droplet from the discharge pulse P2 are discharged, the slope of the droplet amount Mj is also larger than the slope in the range S1 and the range S2.

Figure 8:
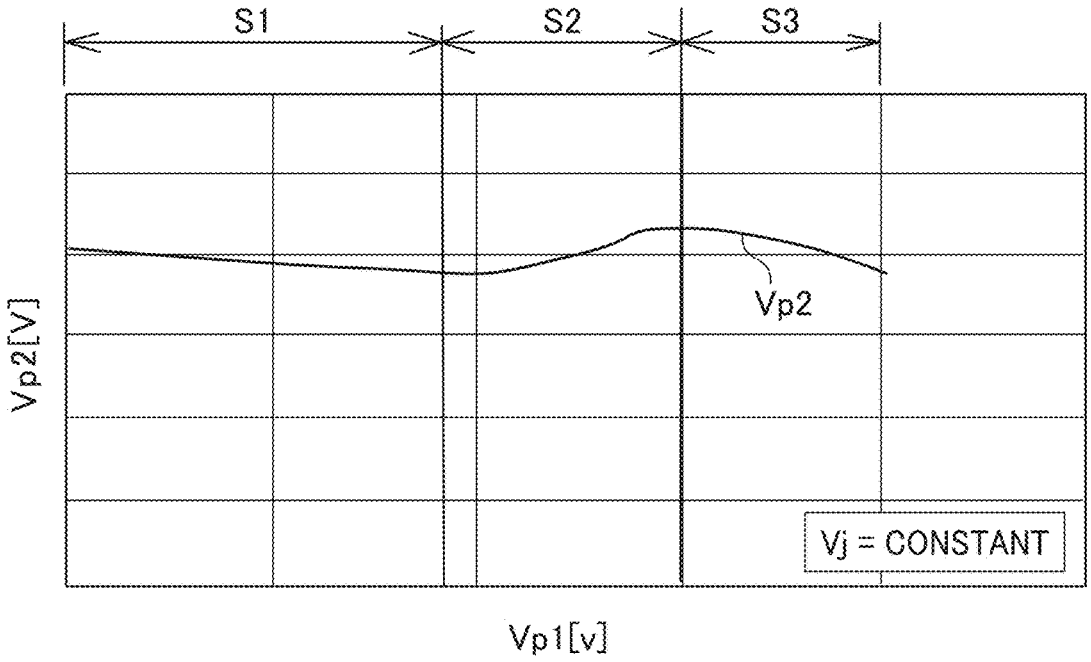
FIG. 8 is a graph illustrating an example of the relationship between peak value of non-discharge pulse and peak value of discharge pulse.

Next, FIG. 8 illustrates an example of the relationship between the peak value Vp1 of the non-discharge pulse P1 and the peak value Vp2 of the discharge pulse P2 when the droplet speed Vj is kept constant. Here, the time interval Td between the non-discharge pulse P1 and the discharge pulse P2 is also the natural vibration period Tc.

As in the case of FIG. 7, the range can be divided into three ranges S1, S2, and S3 according to the value of the peak value Vp1 of the non-discharge pulse P1.

First, in the range S1, the peak value Vp2 of the discharge pulse P2 is likely to decrease as the peak value Vp1 of the non-discharge pulse P1 increases. This indicates that since the meniscus vibration increases as the peak value Vp1 of the non-discharge pulse P1 increases, the droplet speed Vj can be kept constant even if the peak value Vp2 of the discharge pulse P2 is decreased.

In the range S2, the droplet speed Vj increases from a local minimum value at the boundary between the range S1 and the range S2. This indicates a state in which the meniscus vibration becomes too large and exceeds the simple harmonic vibration of the meniscus, that is, a state in which the meniscus tends to overflow. Since the meniscus tends to overflow, the energy generated by the discharge pulse P2 is not efficiently transmitted, and the droplet speed Vj is not kept constant unless a larger energy is applied.

In the range S3, the droplet speed Vj decreases from a local maximum value at the boundary between the range S2 and the range S3. Also in this case, similarly to the result of FIG. 7, since the droplet is discharged by the non-discharge pulse P1, the discharge pulse P2 is discharged by normal resonance. As the peak value Vp1 increases, the residual vibration increases. The droplet speed Vj is kept constant even if the peak value Vp2 is decreased.

Figure 9:
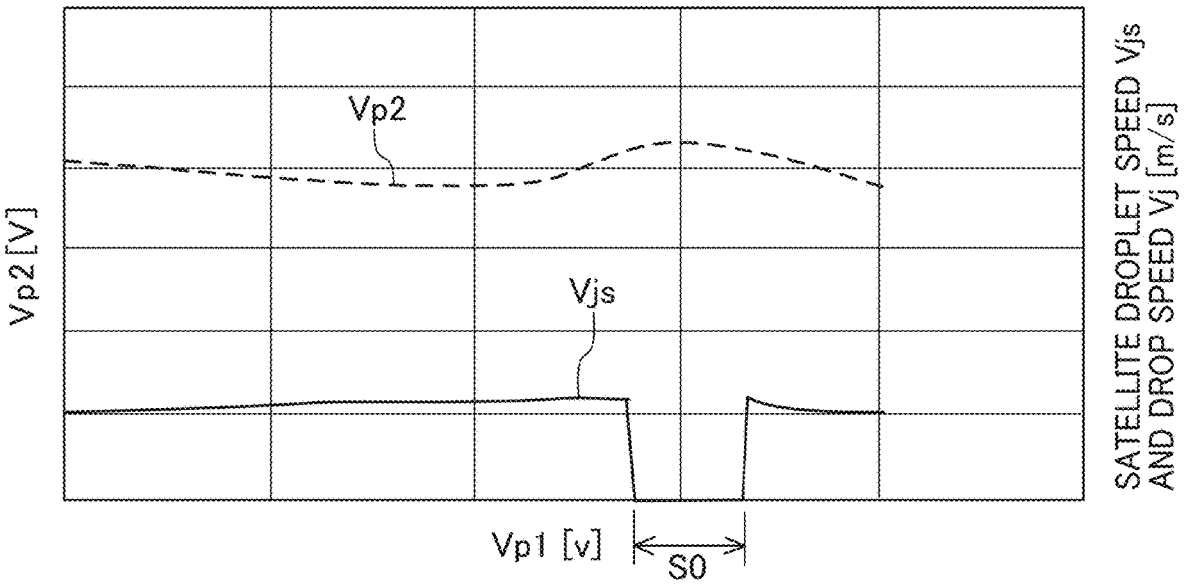
FIG. 9 is a graph illustrating an example of changes in peak value of non-discharge pulse, peak value of discharge pulse, and droplet speed of satellite droplet.

Next, FIG. 9 illustrates an example of a change in satellite droplet when the peak value Vp2 of the discharge pulse P2 is adjusted so that the droplet speed Mj is kept constant.

The satellite droplet speed Vjs slightly increases as the peak value Vp1 of the non-discharge pulse P1 increases. However, there is a (satellite-less) region S0 where the satellite droplet speed Vjs is zero around the peak value Vp1 of the non-discharge pulse P1 corresponding to the vicinity where the peak value Vp2 of the discharge pulse P2 takes the local maximum value (that is, the vicinity of the boundary between the ranges S2 and S3).

The above-described satellite-less region is obtained when the time interval Td between the non-discharge pulse and the discharge pulse is set to be the same as the natural vibration period Tc (Td=Tc). Therefore, the time interval Td between the non-discharge pulse and the discharge pulse was set to be different from the natural vibration period Tc. The peak value Vp2 of the discharge pulse P2 was adjusted so that the droplet speed Mj was constant, and the change of the satellite droplet with respect to the change of the non-discharge pulse P1 was evaluated.

Figure 10:
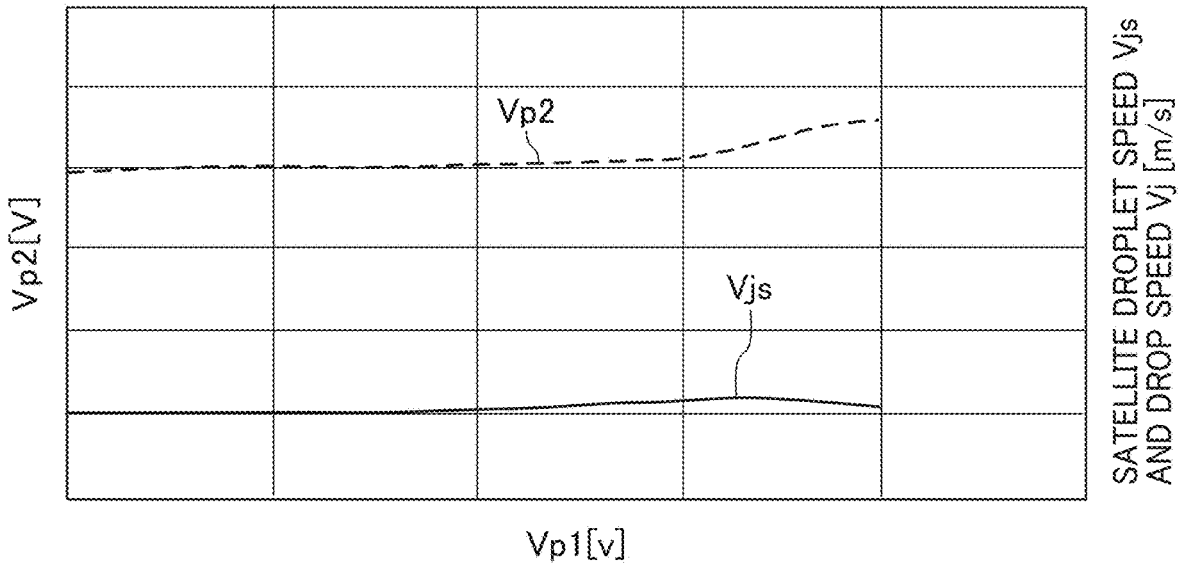
FIG. 10 is a graph illustrating an example of changes in peak value of non-discharge pulse, peak value of discharge pulse, and droplet speed of satellite droplet.

First, FIG. 10 depicts a case where the time interval Td between the non-discharge pulse and the discharge pulse was shortened by (2/5)×Tc with respect to the natural vibration period Tc (Td=Tc−(2/5)×Tc).

Under this condition, the condition of the peak value Vp1 of the non-discharge pulse P1 that creates a satellite-less state is not observed.

Figure 11:
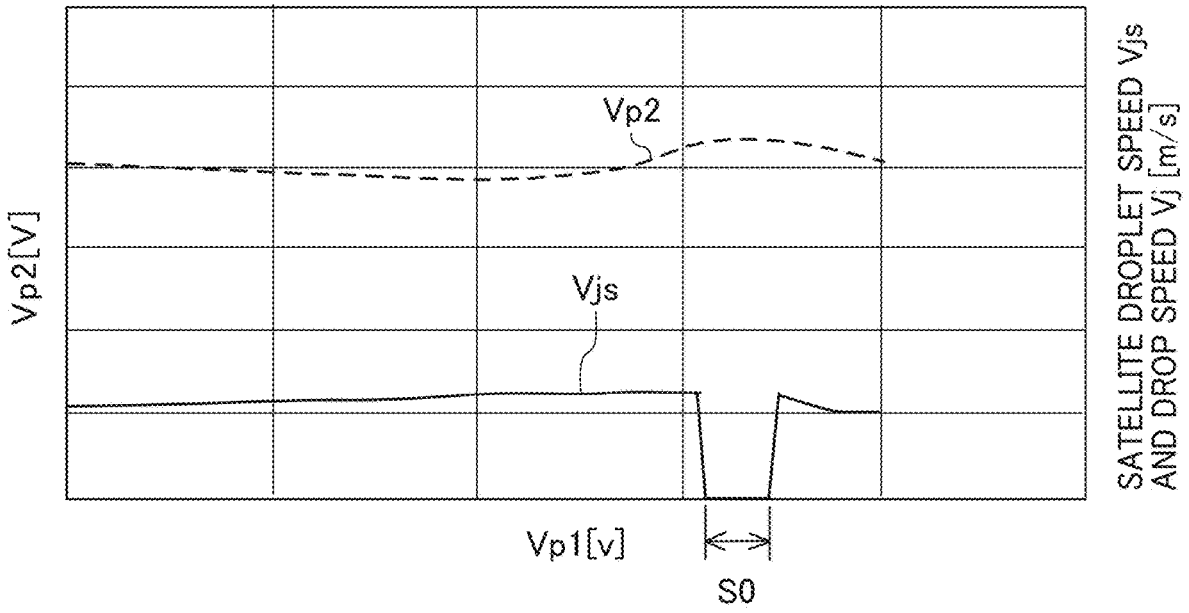
FIG. 11 is a graph illustrating an example of changes in peak value of non-discharge pulse, peak value of discharge pulse, and droplet speed of satellite droplet.

Next, FIG. 11 depicts a case where the time interval Td between the non-discharge pulse and the discharge pulse was shortened by (1/4)×Tc with respect to the natural vibration period Tc (Td=Tc−(1/4)×Tc).

Under this condition, although the range of the peak value Vp1 of the non-discharge pulse P1 was narrower than that in the case of Td=Tc, a satellite-less region S0 was confirmed.

Figure 12:
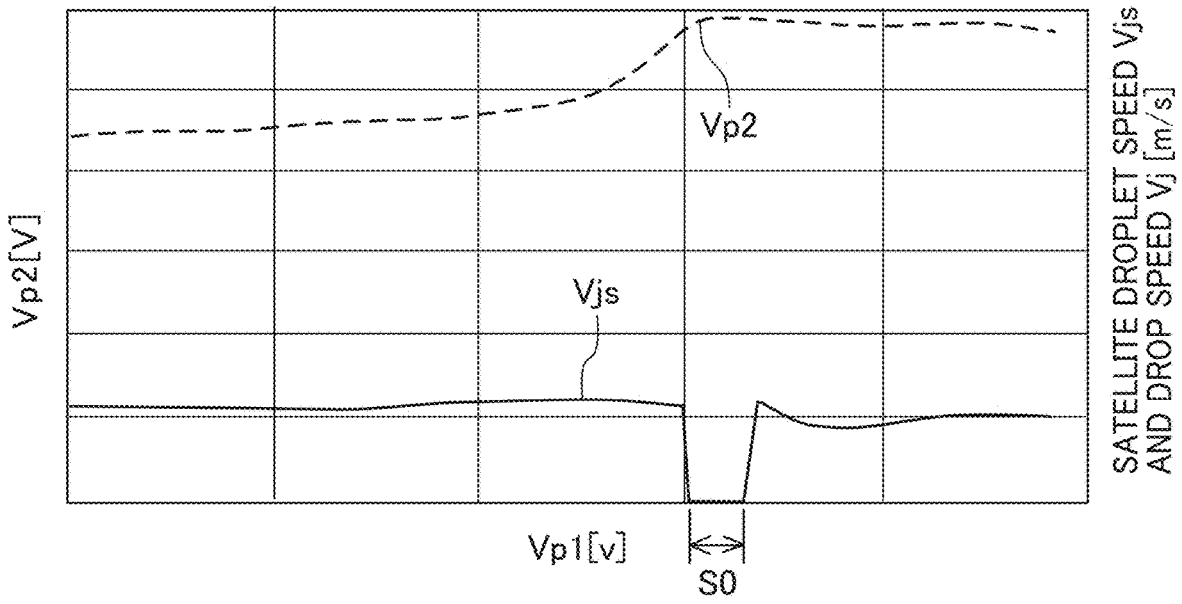
FIG. 12 is a graph illustrating an example of changes in peak value of non-discharge pulse, peak value of discharge pulse, and droplet speed of satellite droplet.

Next, FIG. 12 depicts a case where the time interval Td between the non-discharge pulse and the discharge pulse is set to be longer than the natural vibration period Tc by (1/3)×Tc (Td=Tc+(1/3)×Tc).

Under this condition, although the range of the peak value Vp1 of the non-discharge pulse P1 was narrower than that in the case of Td=Tc, a satellite-less region S0 was confirmed.

Figure 13:
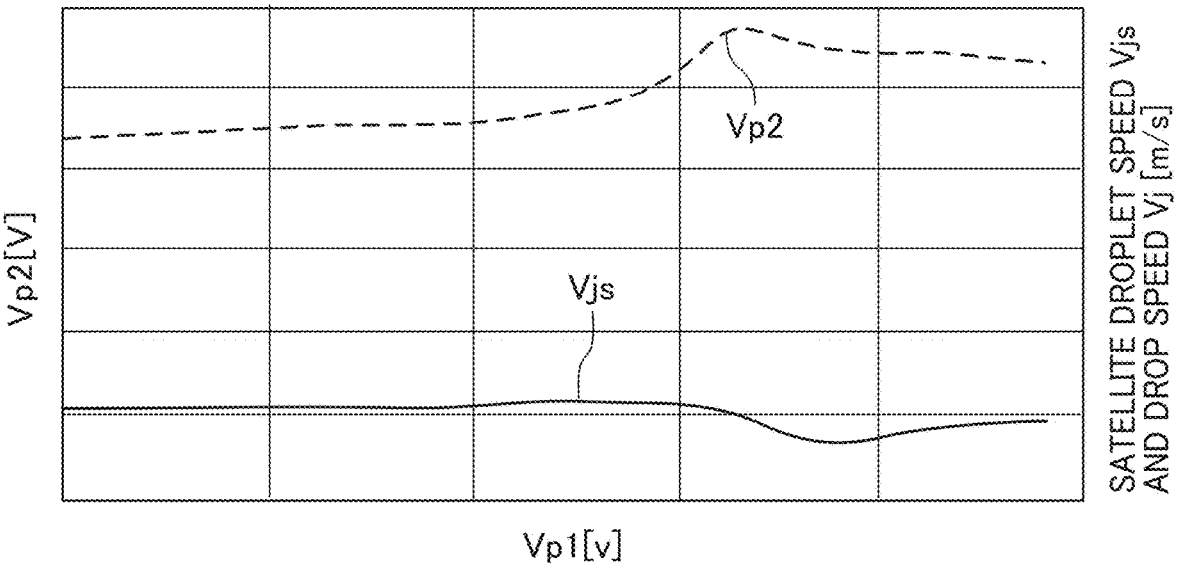
FIG. 13 is a graph illustrating an example of changes in peak value of non-discharge pulse, peak value of discharge pulse, and droplet speed of satellite droplet.

Next, FIG. 13 depicts a case where the time interval Td between the non-discharge pulse and the discharge pulse was set to be longer than the natural vibration period Tc by (1/2)×Tc (Td=Tc+(1/2)×Tc).

Under this condition, the condition of the peak value Vp1 of the non-discharge pulse P1 that creates a satellite-less state is not observed. Further, even if the time interval Td was set to be longer than Tc+(1½)×Tc, the satellite-less condition was not confirmed.

Next, based on the above results, the relationship between the natural vibration period Tc and the time interval Td between the non-discharge pulse and the discharge pulse that can create a satellite-less state and the peak value Vp1 of the non-discharge pulse P1 are described with reference to FIGS. 14 to 18.

Figure 14:
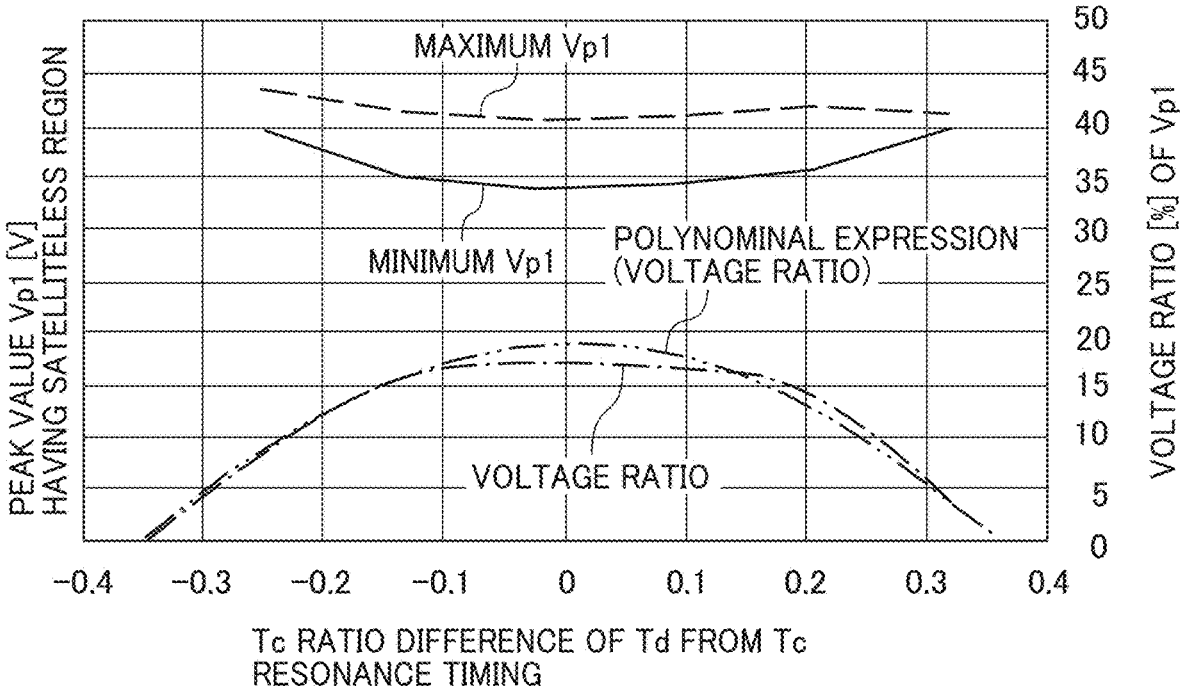
FIG. 14 is a graph illustrating an example of the relationship between maximum value and minimum value of peak value of non-discharge pulse that create a satellite-less state and the voltage ratio of the peak value of non-discharge pulse.

FIG. 14 depicts the relationship among the maximum value and the minimum value of the peak value Vp1 of the non-discharge pulse P1 creating the satellite-less region S0 and the voltage ratio of the peak value Vp1 of the non-discharge pulse P1.

The horizontal axis of FIG. 14 represents the Tc ratio difference (difference converted as a ratio to Tc) of the time interval Td between the non-discharge pulse P1 and the discharge pulse P2 from the natural vibration period Tc (resonance timing). For example, the Tc ratio difference of "0.1" indicates that the evaluation result is obtained at a time interval Td (Td=Tc+0.1×Tc) longer than a time interval Td having the same time length as the natural vibration period Tc by (0.1×Tc).

Figure 15:
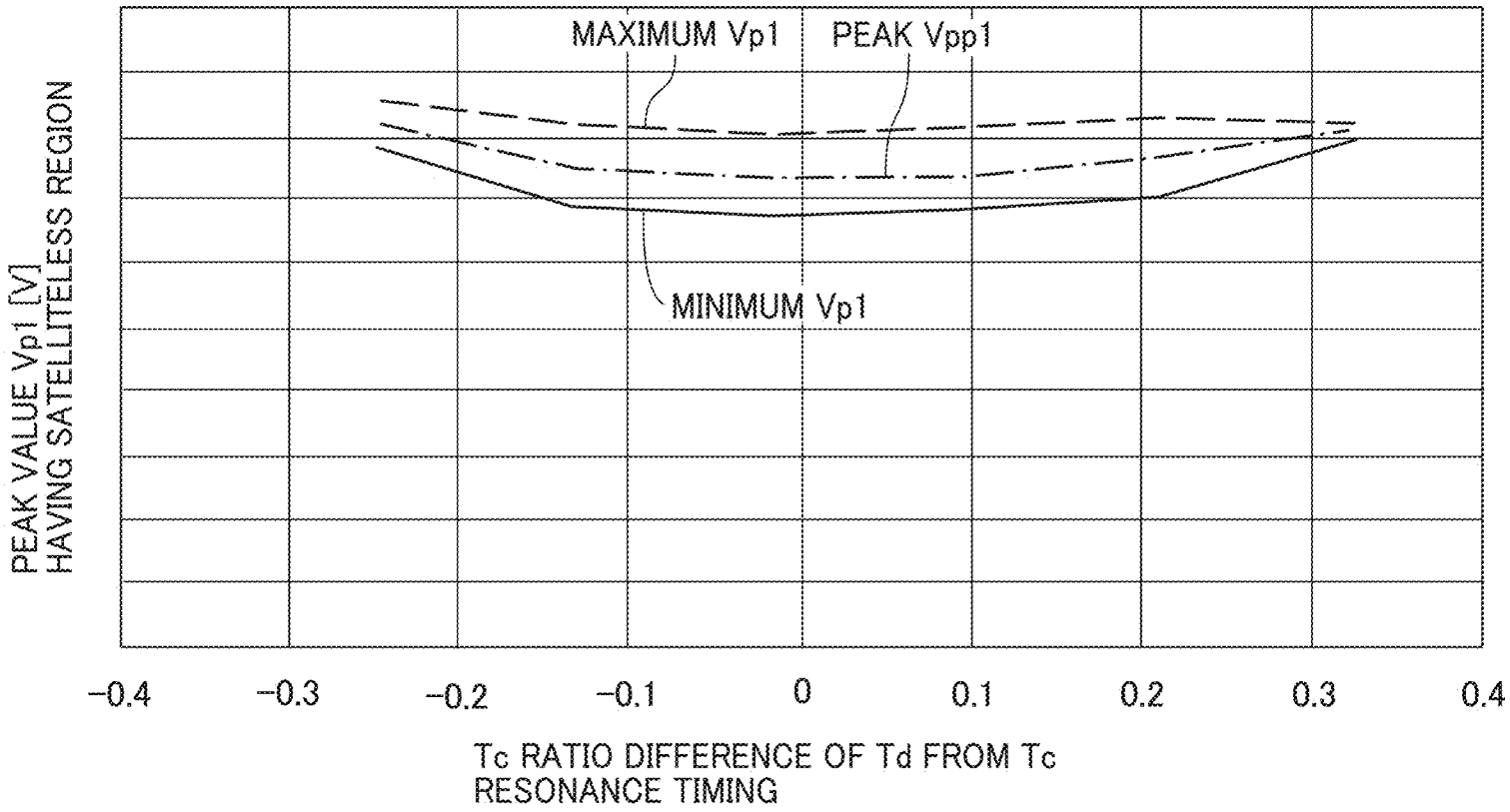
FIG. 15 is a graph illustrating a time interval Td at which the satellite-less state occurs and the peak value of the non-discharge pulse.

FIG. 15 depicts a summary of the maximum value and the minimum value of the peak value Vp1 of the non-discharge pulse P1 that create a satellite-less state, and the value of the peak value Vp1 (referred to as "peaked peak value Vpp1") when the peak value Vp2 of the discharge pulse P2 takes a peak (when the droplet speed of the liquid discharged by the discharge pulse becomes a local minimum value).

Similarly to FIG. 14, the horizontal axis of FIG. 15 represents the Tc ratio difference (difference converted as a ratio to Tc) of the time interval Td between the non-discharge pulse P1 and the discharge pulse P2 from the natural vibration period Tc (resonance timing). For example, the Tc ratio difference of "0.1" indicates that the evaluation result is obtained at a time interval Td (Td=Tc+0.1×Tc) longer than a time interval Td having the same time length as the natural vibration period Tc by (0.1×Tc).

Figure 16:
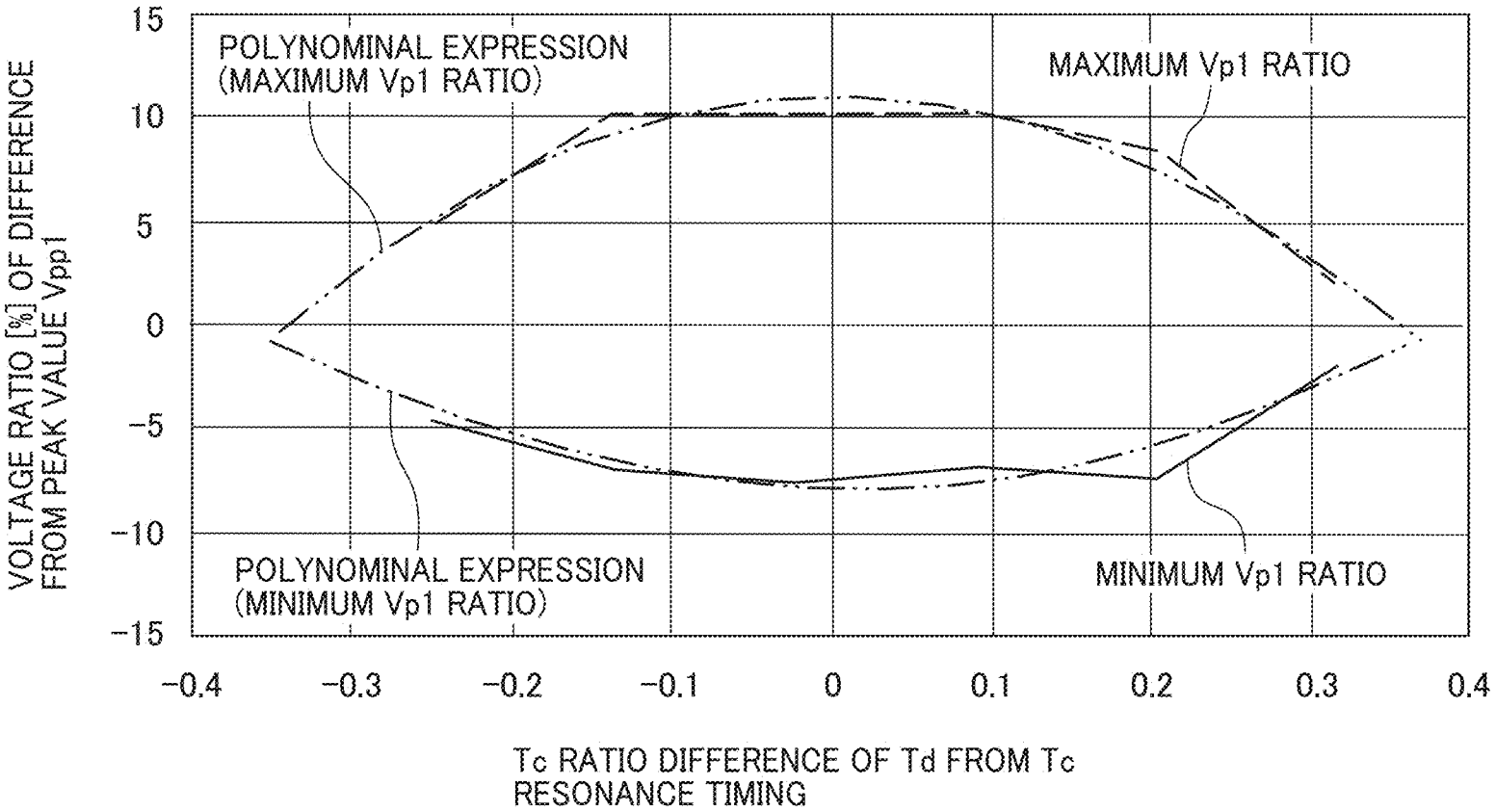
FIG. 16 is a graph illustrating the time interval Td at which the satellite-less state occurs and the peak value of the non-discharge pulse.
Figure 17:
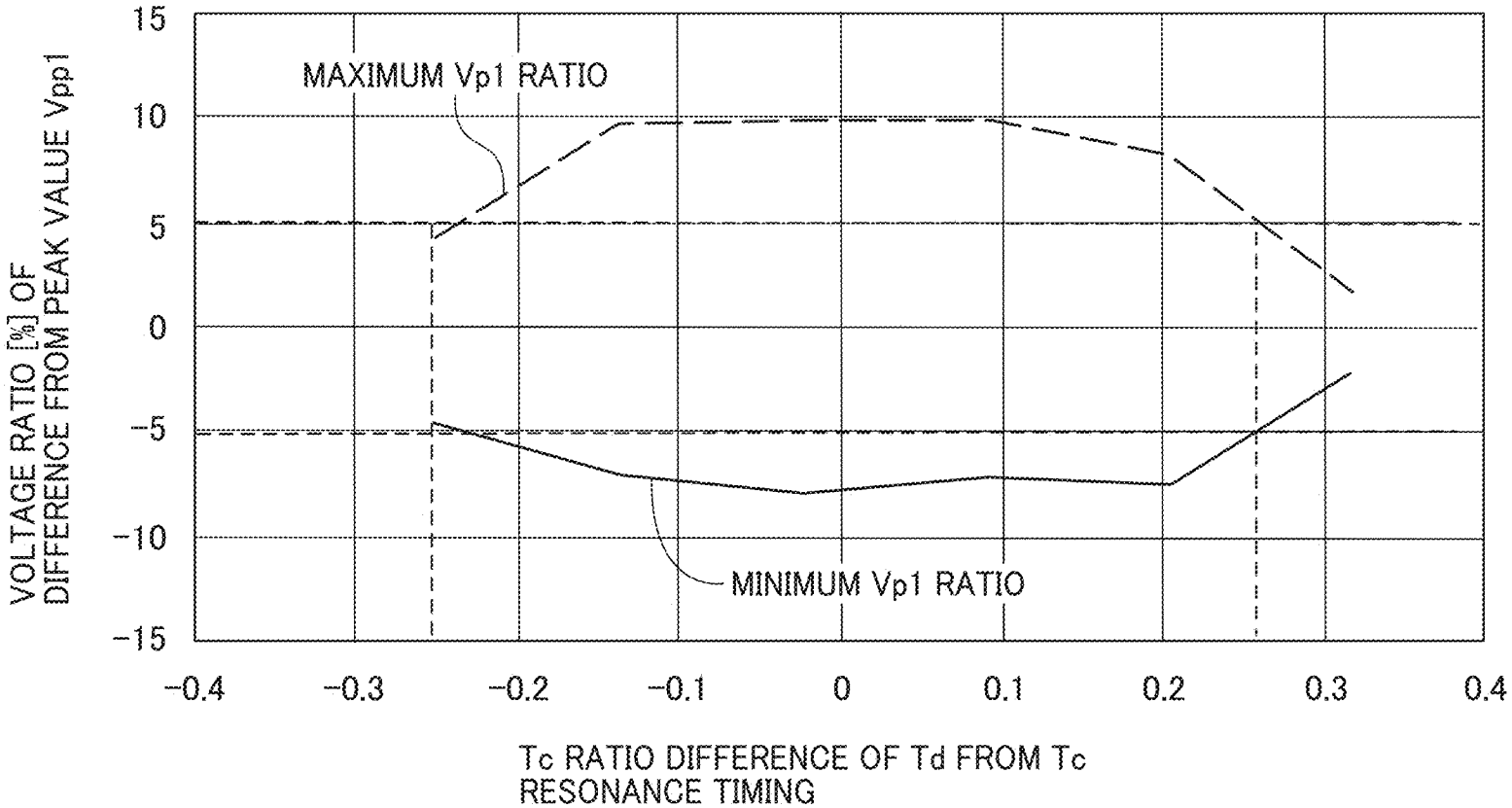
FIG. 17 is a graph illustrating the time interval Td at which the satellite-less state occurs and the peak value of the non-discharge pulse.
Figure 18:
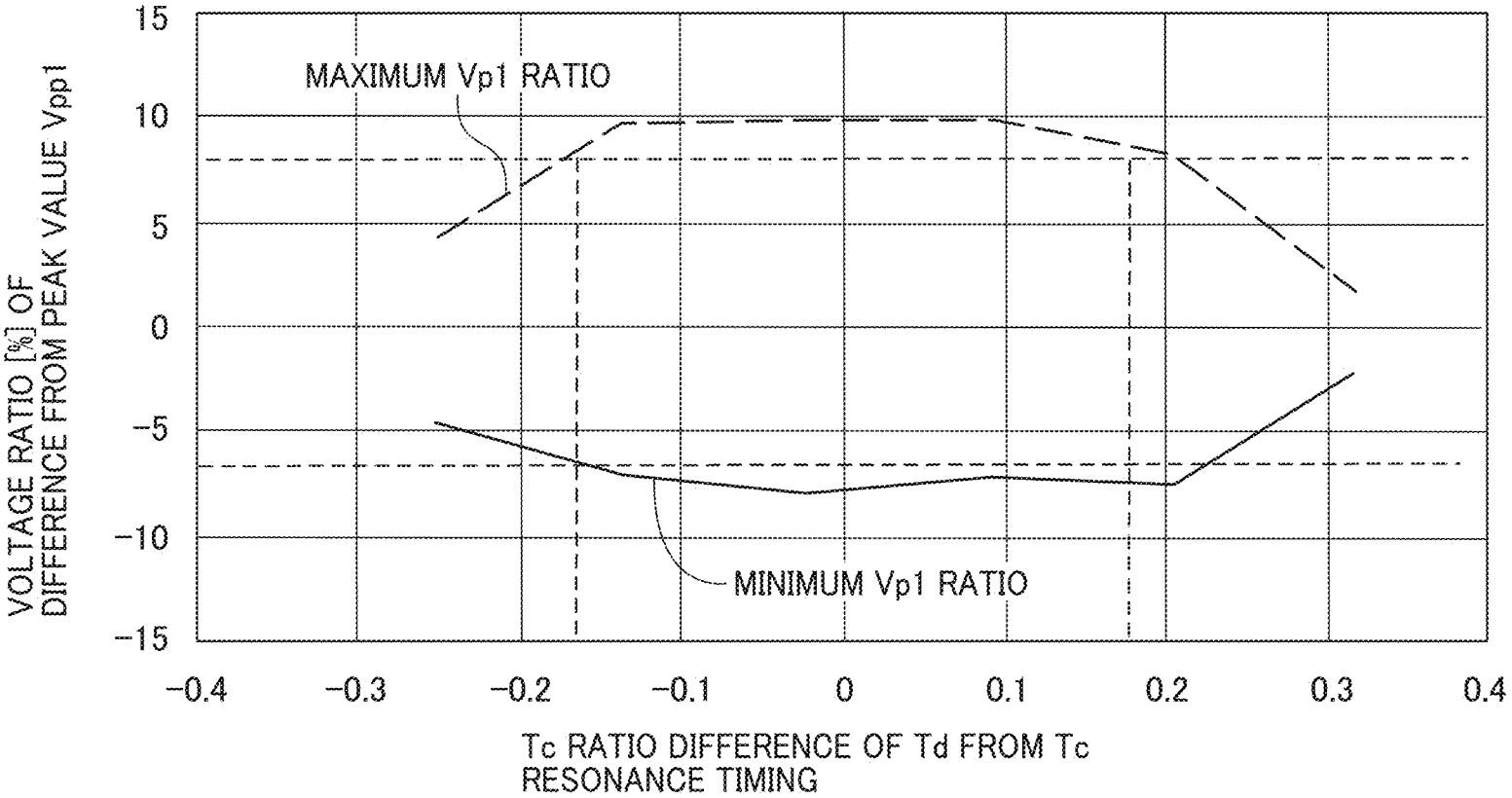
FIG. 18 is a graph illustrating the time interval Td at which the satellite-less state occurs and the peak value of the non-discharge pulse.

FIGS. 16 to 18 depict a voltage range between the maximum value (maximum Vp1) and the minimum value (minimum Vp1) of the peak value Vp1 of the non-discharge pulse P1 as a ratio of a voltage difference from the peaked peak value Vpp1.

Similarly to FIG. 15, the horizontal axis of FIGS. 16 to 18 represent the Tc ratio difference (difference converted as a ratio to Tc) of the time interval Td between the non-discharge pulse P1 and the discharge pulse P2 from the natural vibration period Tc (resonance timing). For example, the Tc ratio difference of "0.1" indicates that the evaluation result is obtained at a time interval Td (Td=Tc+0.1×Tc) longer than a time interval Td having the same time length as the natural vibration period Tc by (0.1×Tc).

From FIGS. 16 to 18, it can be seen that when the time interval Td between the non-discharge pulse P1 and the discharge pulse P2 is shifted from the natural vibration period Tc as the center, the voltage range of the peak value Vp1 of the non-discharge pulse P1 which can create a satellite-less state is narrowed.

The time interval Td between the non-discharge pulse P1 and the discharge pulse P2, which can create a satellite-less state, is ±⅓×Tc (within the range of Tc−(⅓)×Tc to Tc+(⅓)×Tc) with the natural vibration period Tc as the center.

In addition, it can be seen that the non-discharge pulse P1 is within the range of "−10% to +10%" of the peaked peak value Vpp1 which is the peak value Vp1 when the droplet speed Vj of the liquid discharged by the discharge pulse P2 becomes a local minimum value, that is, when the peak value Vp2 of the discharge pulse P2 takes a peak.

Here, in order to secure a voltage margin of Δ10% (±5%: −5% to +5%) or more, it is preferable that the time interval Td between the non-ejection pulse P1 and the ejection pulse P2 is set within a range of Tc−(¼)×Tc to Tc+(¼)×Tc.

In addition, in order to secure a voltage margin of Δ15% (±7.5%: −7.5% to +7.5%) or more, it is preferable that the time interval Td between the non-discharge pulse P1 and the discharge pulse P2 is set within a range of Tc−(⅙)×Tc to Tc+(⅙)×Tc.

Further, setting the time interval Td between the non-ejection pulse P1 and the ejection pulse P2 to the natural vibration period Tc (Td=Tc) can secure a voltage margin of Δ20% (±10.0%: −10.0% to +10.0%) or more.

Next, the peak value Vp2 of the non-discharge pulse P1 that becomes satellite-less at each time interval Td between the non-discharge pulse P1 and the discharge pulse P2 was set to a fixed value, and the voltage characteristic based on the peak value Vp1 of the discharge pulse P2 was acquired.

The value of the peak value Vp1 of the non-discharge pulse P1 is approximately the median value of the maximum values of the peak value Vp1 and the peak value Vp2. More specifically, when the peak value Vp2 of the discharge pulse P2 is adjusted so that the droplet speed Vj by the discharge pulse P2 becomes constant, the peak value Vp2 is set to the value of the peak value Vp1 of the non-discharge pulse P1 when the peak value Vp2 takes the local maximum value.

Figure 19:
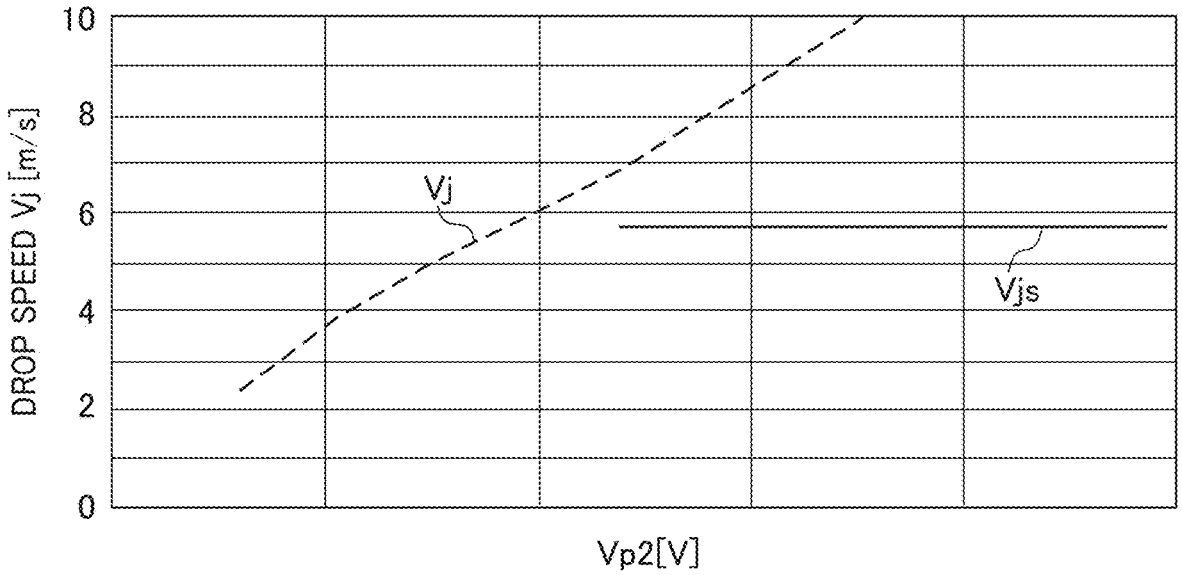
FIG. 19 is a graph illustrating voltage characteristics when a simple pull waveform is used.

First, FIG. 19 depicts a voltage characteristic observed when a simple pull waveform (corresponding to Vp1=0V) is used.

Here, UV ink is used as the liquid to be discharged. In the example of FIG. 19, the droplet speed Vj is about 7 m/s, and the droplet speed Vjs of the satellite is about 5.7 m/s.

Figure 20:
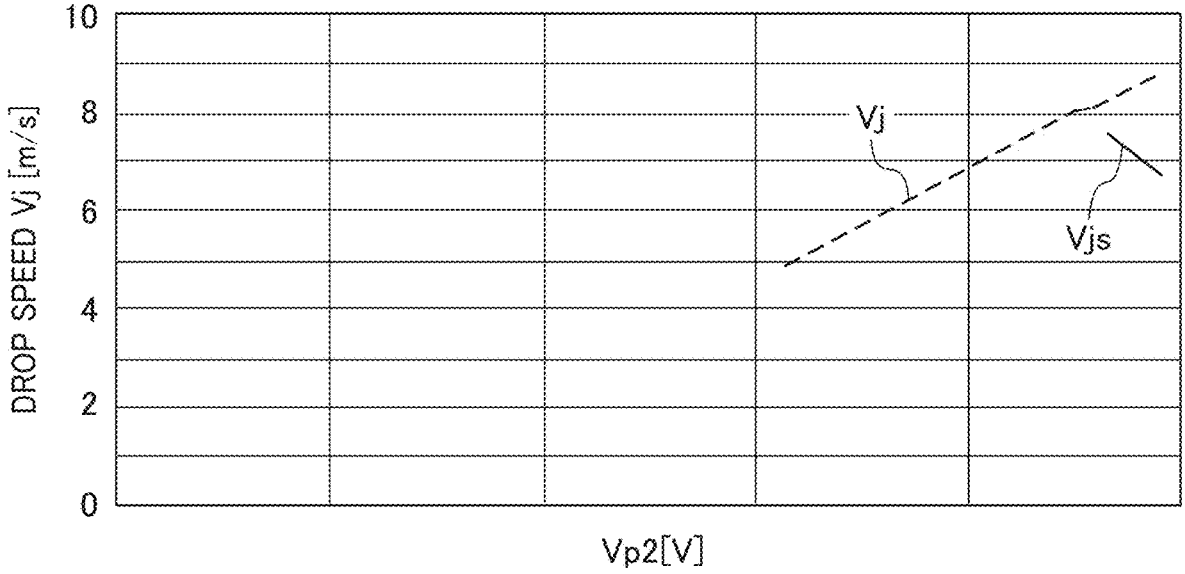
FIG. 20 is a graph illustrating voltage characteristics when the time interval between a non-discharge pulse and a discharge pulse is set as a natural vibration period.

Next, FIG. 20 depicts a voltage characteristic observed when the time interval Td between the non-discharge pulse P1 and the discharge pulse P2 is set as the natural vibration period Tc.

In this case, satellites are not generated until the droplet speed Vj exceeds 8 m/s.

The satellite shortening effect is about 0.5 m/s to about 1.0 m/s in a conventional satellite shortening waveform, whereas the satellite shortening effect is about 2.5 m/s to about 3 m/s in the present embodiment. Thus, the shortening effect is significantly enhanced.

The droplet speed Vj is often set to about 7 m/s to about 9 m/s from the viewpoint of the landing position accuracy and the discharge stability. Since he occurrence of satellites can be prevented up to about 8 m/s, satellite-less discharge can be achieved in a practical range of droplet speed.

In the non-discharge pulse P1, the holding time of the timing (the holding waveform element b1) of the expansion waveform element a1 and the contraction waveform element c1 may be the natural vibration period Tc or may be shorter than the natural vibration period Tc. If the holding time is set shorter than the natural vibration period Tc, the waveform length can be shortened.

In addition, the waveform formed by the combination of the non-discharge pulse P1 and the discharge pulse P2 is positioned at the end of the waveform configuration in which a large droplet is formed by a plurality of discharge pulses, thus allowing satellite-less discharge or satellite shortening even for a large droplet.

Figure 21:
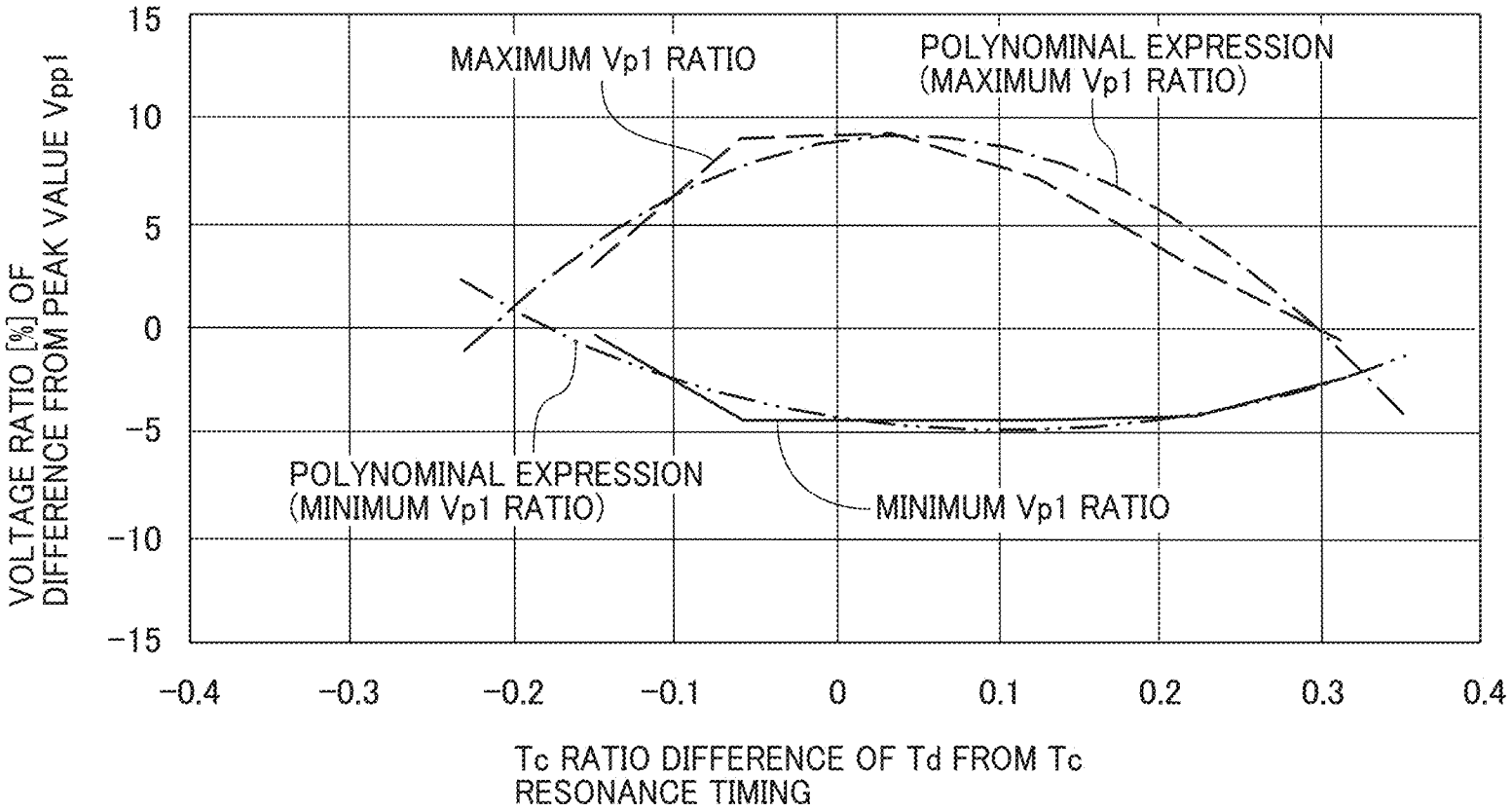
FIG. 21 is a graph illustrating the time interval Td at which the satellite-less state occurs and the peak value of the non-discharge pulse in a second embodiment of the present disclosure.
Figure 22:
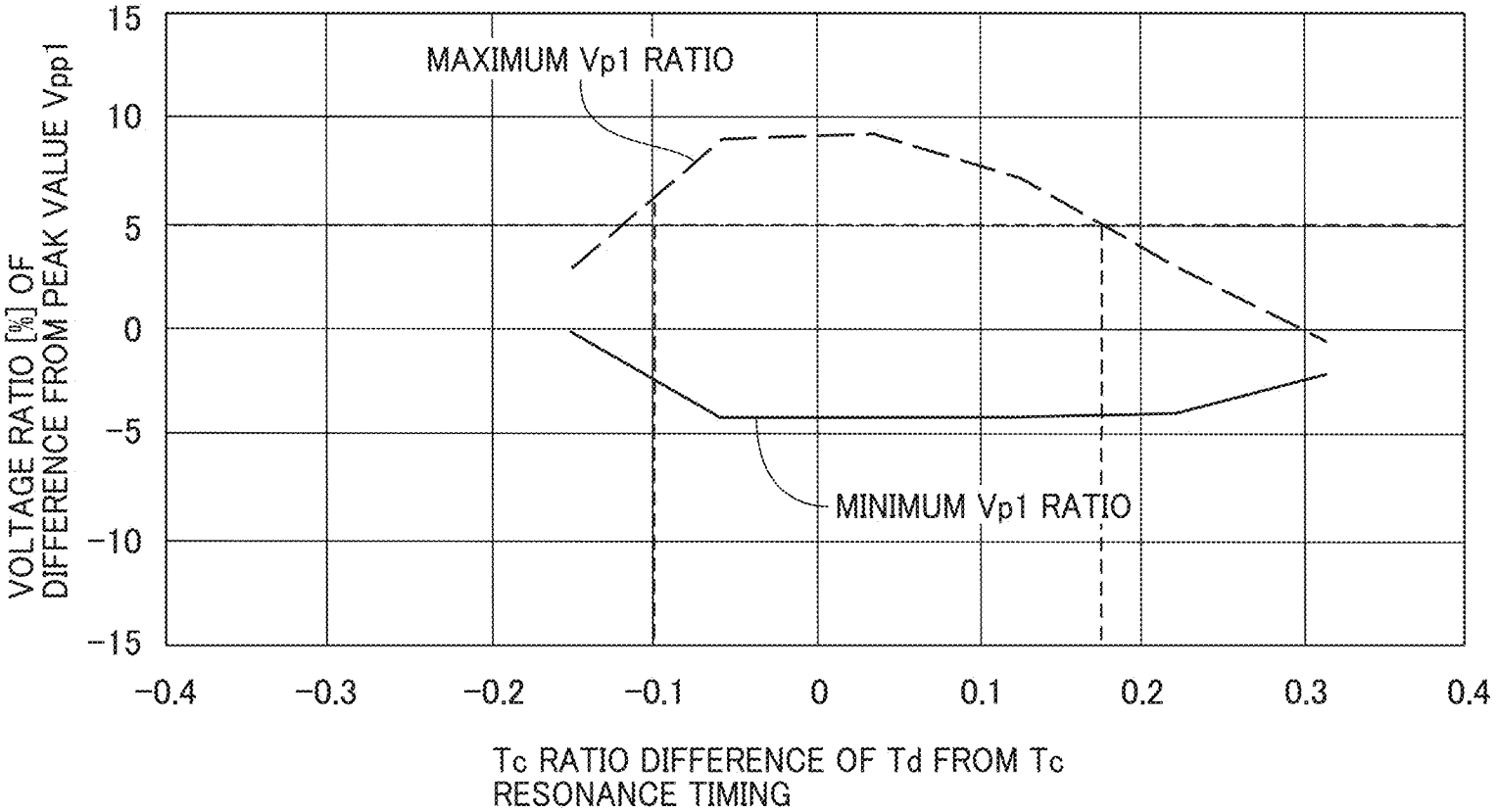
FIG. 22 is a graph illustrating the time interval Td at which the satellite-less state occurs and the peak value of the non-discharge pulse.
Figure 23:
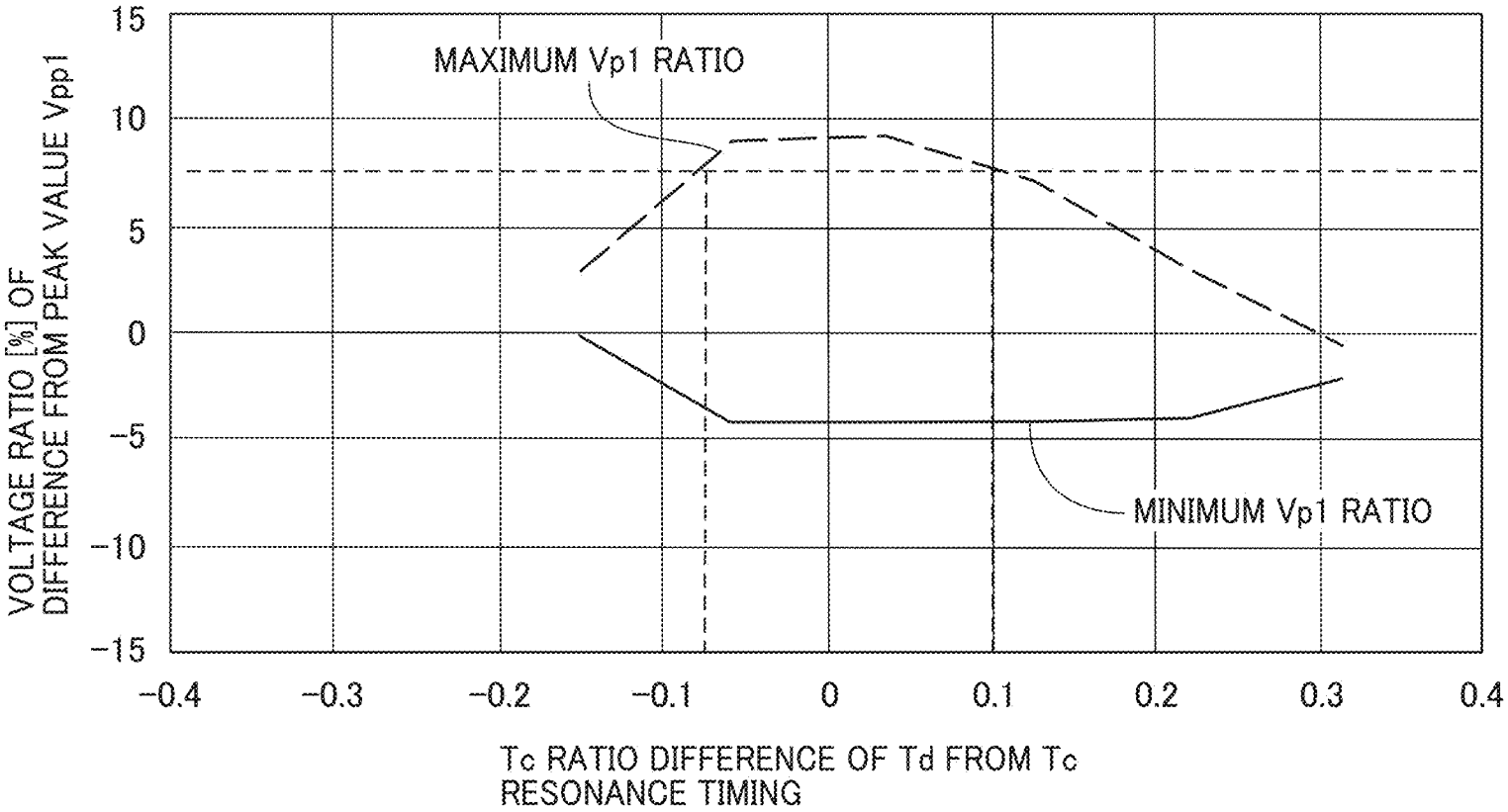
FIG. 23 is a graph illustrating the time interval Td at which the satellite-less state occurs and the peak value of the non-discharge pulse.

Referring to FIGS. 21 to 23, a description is given of a second embodiment according to the present disclosure. FIGS. 21 to 23 are graphs illustrating the relationship between the natural vibration period Tc and the time interval Td between the non-discharge pulse and the discharge pulse, which can create a satellite-less state, and the peak value Vp1 of the non-discharge pulse P1 in the second embodiment.

FIGS. 21 to 23 depict a voltage range between the maximum value (maximum Vp1) and the minimum value (minimum Vp1) of the peak value Vp1 of the non-discharge pulse P1 as a ratio of a voltage difference from the peaked peak value Vpp1.

Similarly to the above-described embodiment, the horizontal axis of FIGS. 21 to 23 represent the Tc ratio difference (difference converted as a ratio to Tc) of the time interval Td between the non-discharge pulse P1 and the discharge pulse P2 from the natural vibration period Tc (resonance timing). For example, the Tc ratio difference of "0.1" indicates that the evaluation result is obtained at a time interval Td (Td=Tc+0.1×Tc) longer than a time interval Td having the same time length as the natural vibration period Tc by (0.1×Tc).

In the present embodiment, the time interval Td between the non-discharge pulse P1 and the discharge pulse P2, which can create a satellite-less state, is in the range of Tc−(⅕)×Tc to Tc+(⅓)×Tc.

In addition, it can be seen that the non-discharge pulse P1 is within the range of "−5% to +10%" of the peaked peak value Vpp1 which is the peak value Vp1 when the droplet speed Vj of the liquid discharged by the discharge pulse P2 becomes a local minimum value, that is, when the peak value Vp2 of the discharge pulse P2 takes a peak.

Here, in order to secure a voltage margin of ±5% (−5% to +5%) or more, it is preferable that the time interval Td between the non-discharge pulse P1 and the discharge pulse P2 is set within the range of Tc−(1/10)×Tc to Tc+(1/14)×Tc from FIG. 22.

In addition, in order to secure the voltage margin of ±7.5% (−7.5% to +7.5%) or more, it is preferable that the time interval Td between the non-discharge pulse P1 and the discharge pulse P2 is set within the range of Tc−(1/6)×Tc to Tc+(1/10)×Tc from FIG. 23.

Figure 24:
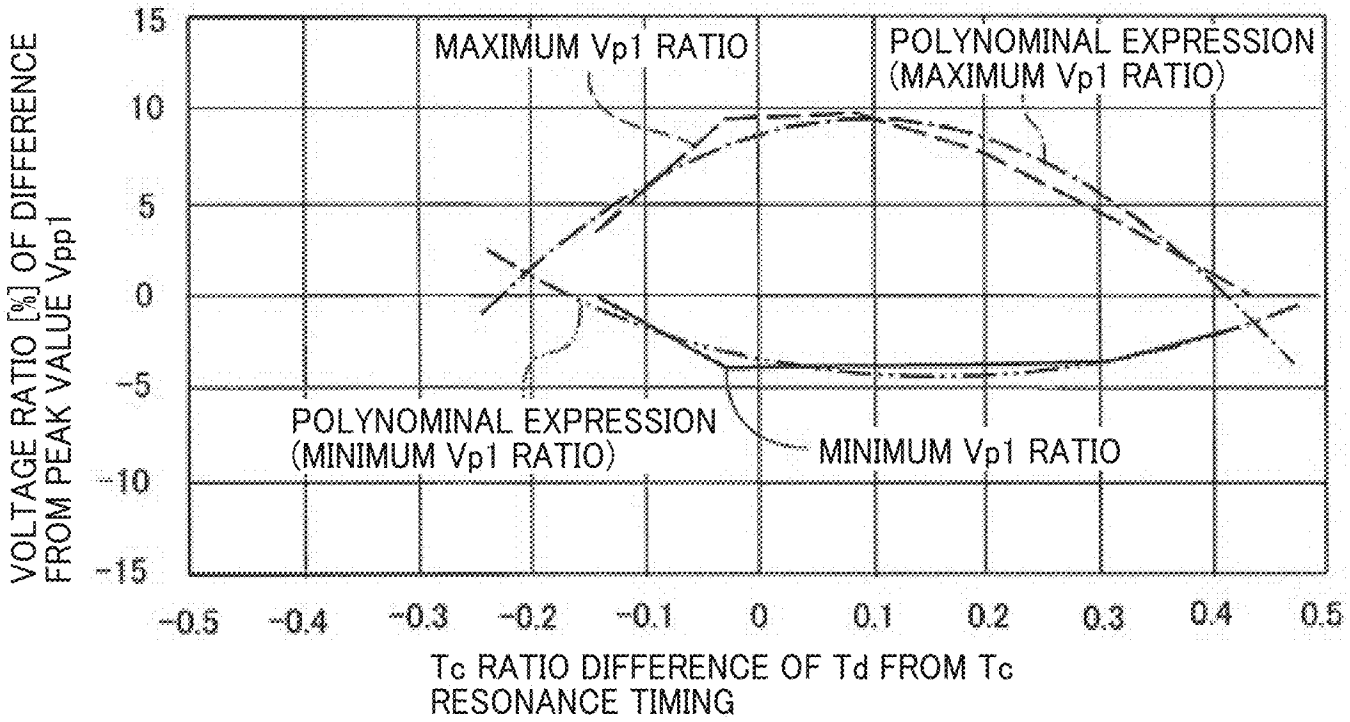
FIG. 24 is a graph illustrating the time interval Td at which the satellite-less state occurs and the peak value of the non-discharge pulse in a third embodiment of the present disclosure.
Figure 25:
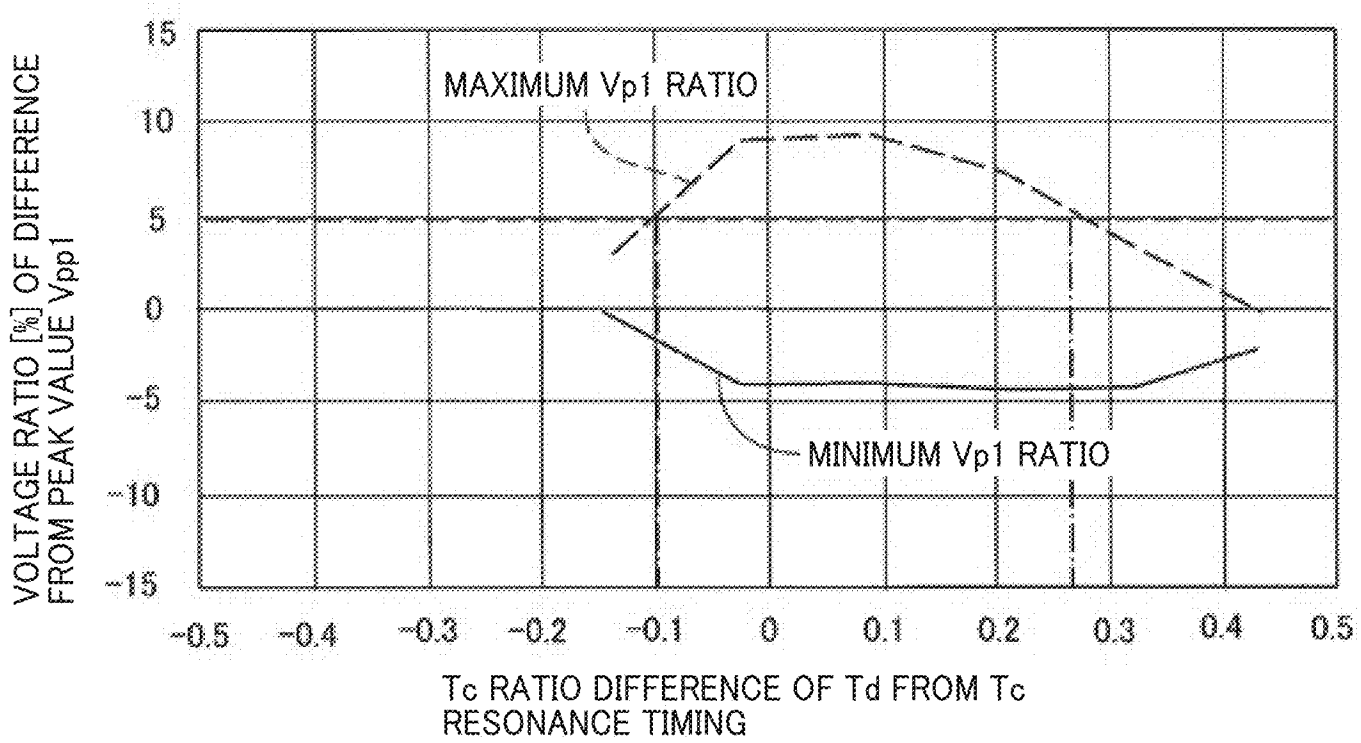
FIG. 25 is a graph illustrating the time interval Td at which the satellite-less state occurs and the peak value of the non-discharge pulse.
Figure 26:
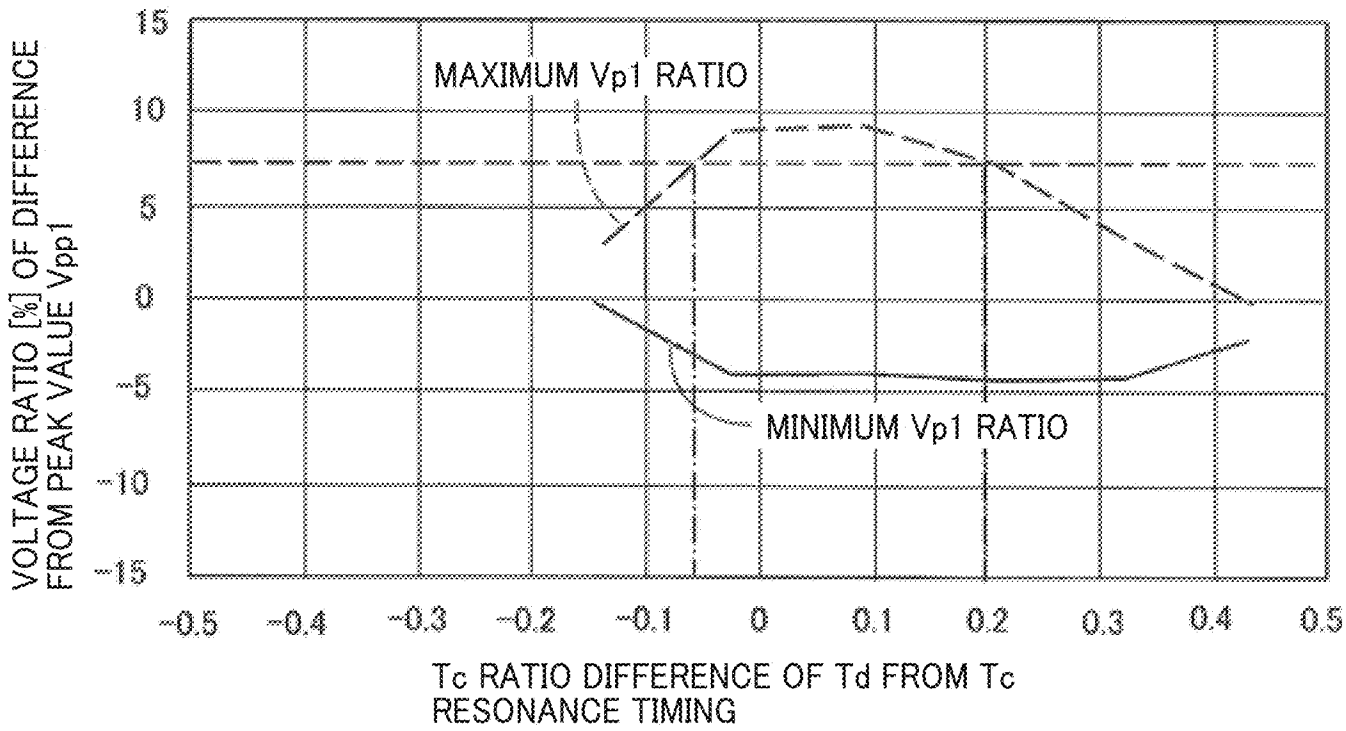
FIG. 26 is a graph illustrating the time interval Td at which the satellite-less state occurs and the peak value of the non-discharge pulse.

Referring to FIGS. 24 to 26, a description is given of a third embodiment of the present disclosure. FIGS. 24 to 26 are graphs illustrating the relationship between the natural vibration period Tc and the time interval Td between the non-discharge pulse and the discharge pulse, which can create a satellite-less state, and the peak value Vp1 of the non-discharge pulse P1 in the second embodiment.

FIGS. 24 to 26 depict a voltage range between the maximum value (maximum Vp1) and the minimum value (minimum Vp1) of the peak value Vp1 of the non-discharge pulse P1 as a ratio of a voltage difference from the peaked peak value Vpp1.

The horizontal axis of FIGS. 24 to 26 represent the Tc ratio difference (difference converted as a ratio to Tc) of the time interval Td between the non-discharge pulse P1 and the discharge pulse P2 from the natural vibration period Tc (resonance timing). For example, the Tc ratio difference of "0.1" indicates that the evaluation result is obtained at a time interval Td (Td=Tc+0.1×Tc) longer than a time interval Td having the same time length as the natural vibration period Tc by (0.1×Tc).

In the present embodiment, the time interval Td between the non-discharge pulse P1 and the discharge pulse P2, which can create a satellite-less state, is within a range of Tc−0.2×Tc to Tc+0.45×Tc.

In addition, it can be seen that the non-discharge pulse P1 is within the range of "−5% to +10%" of the peaked peak value Vpp1 which is the peak value Vp1 when the droplet speed Vj of the liquid discharged by the discharge pulse P2 becomes a local minimum value, that is, when the peak value Vp2 of the discharge pulse P2 takes a peak.

Here, in order to secure the voltage margin of ±5% (−5% to +5%) or more, it is preferable that the time interval Td between the non-discharge pulse P1 and the discharge pulse P2 is set to be within a range of Tc−0.1×Tc to Tc+0.25×Tc, in other words, a range of Tc−(1/10)×Tc to Tc+(1/4)×Tc from FIG. 25.

In addition, in order to secure the voltage margin of ±7.5% (−7.5% to +7.5%) or more, it is preferable that the time interval Td between the non-discharge pulse P1 and the discharge pulse P2 is set to be within a range of Tc−0.07×Tc to Tc+0.2×Tc, in other words, a range of Tc−(1/4)×Tc to Tc+(1/5)×Tc from FIG. 26.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion that contains, for example, a solvent such as water and an organic solvent, a colorant such as dye and pigment, a functional material such as a polymerizable compound, a resin, and a surfactant, a biocompatible material such as deoxyribonucleic acid (DNA), amino acid, protein, and calcium, or an edible material such as a natural colorant. Such a solution, a suspension, and an emulsion are used for, e.g., inkjet ink, a surface treatment solution, a liquid for forming components of an electronic element and a light-emitting element or a resist pattern of an electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

Examples of the liquid discharge apparatus include, not only apparatuses capable of discharging liquid to materials to which liquid can adhere, but also apparatuses to discharge a liquid toward gas or into a liquid.

The liquid discharge apparatus can include at least one of devices for feeding, conveying, and ejecting a material to which liquid can adhere. The liquid discharge apparatus can further include at least one of a pretreatment apparatus and a post-treatment apparatus.

The liquid discharge apparatus may be, for example, an image forming apparatus to form an image on a sheet by discharging ink, or a three-dimensional fabricating apparatus (solid-object fabricating apparatus) to discharge a fabrication liquid to a powder layer in which powder material is formed in layers, so as to form a three-dimensional fabrication object (solid fabrication object).

In addition, the liquid discharge apparatus is not limited to an apparatus that discharges liquid to produce meaningful visible images such as texts and figures For example, the liquid discharge apparatus includes an apparatus to form meaningless images, such as meaningless patterns, or fabricate three-dimensional images.

The above-described term "material onto which liquid adheres" denotes, for example, a material or a medium onto which liquid is adhered at least temporarily, a material or a medium onto which liquid is adhered and fixed, or a material or a medium onto which liquid is adhered and into which the liquid permeates. Examples of the "material on which liquid can be adhered" include recording media such as a paper sheet, recording paper, and a recording sheet of paper, film, and cloth, electronic components such as an electronic substrate and a piezoelectric element, and media such as a powder layer, an organ model, and a testing cell. The "material on which liquid can be adhered" includes any material on which liquid adheres unless particularly limited.

Examples of the "material to which liquid can be adhered" include any materials on which liquid can be adhered even temporarily, such as paper, thread, fiber, fabric, leather, metal, plastic, glass, wood, and ceramic.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the "liquid discharge apparatus" further include a treatment liquid coating apparatus to discharge a treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A liquid discharge apparatus comprising:

a liquid discharge head configured to discharge liquid; and control circuitry configured to generate a drive waveform including a plurality of drive pulses applied to the liquid discharge head, the drive waveform including a non-discharge pulse not to discharge the liquid and a discharge pulse to discharge the liquid, the non-discharge pulse and the discharge pulse being serial in time in the drive waveform, Td being in a range of Tc−0.2×Tc to Tc+0.45×Tc, and Vp1 being in a range of −10% to +10% of Vpp1, where Td represents a time interval between the non-discharge pulse and the discharge pulse, Tc represents a natural vibration period of a pressure chamber of the liquid discharge head, Vp1 represents a peak value of the non-discharge pulse, and Vpp1 represents a peak value of the non-discharge pulse at which a droplet speed of liquid discharged by the discharge pulse takes a local minimum value.

2. The liquid discharge apparatus according to claim 1, wherein Td is in a range of Tc−0.1×Tc to Tc+0.25×Tc.

3. The liquid discharge apparatus according to claim 1, wherein Td is in a range of Tc−0.07×Tc to Tc+0.2×Tc.

4. The liquid discharge apparatus according to claim 1, wherein Vp1 is in a range of −7.5% to +7.5% of Vpp1.

5. The liquid discharge apparatus according to claim 1, wherein Vp1 is in a range of −5% to +5% of Vpp1.

6. The liquid discharge apparatus according to claim 1, wherein the non-discharge pulse includes:

an expansion waveform element to expand a pressure chamber;

a holding waveform element to hold an expanded state of the pressure chamber; and a contraction waveform element to contract the pressure chamber from the expanded state of the pressure chamber held by the holding waveform element, and a holding time in which the holding waveform element holds the expanded state of the pressure chamber is shorter than Tc.

7. The liquid discharge apparatus according to claim 1, wherein the drive waveform includes a plurality of discharge pulses, and the discharge pulse is a last pulse of the plurality of discharge pulses.

8. A drive waveform generating device comprising:

a liquid discharge head configured to discharge liquid; and control circuitry configured to generate a drive waveform including a plurality of drive pulses applied to the liquid discharge head, the drive waveform including a non-discharge pulse not to discharge the liquid and a discharge pulse to discharge the liquid, the non-discharge pulse and the discharge pulse being serial in time in the drive waveform, Td being in a range of Tc−0.2×Tc to Tc+0.45×Tc, and Vp1 being in a range of −10% to +10% of Vpp1, where Td represents a time interval between the non-discharge pulse and the discharge pulse, Tc represents a natural vibration period of a pressure chamber of the liquid discharge head, Vp1 represents a peak value of the non-discharge pulse, and Vpp1 represents a peak value of the non-discharge pulse at which a droplet speed of liquid discharged by the discharge pulse takes a local minimum value.

9. A head driving method of driving a liquid discharge head, the method comprising:

generating a drive waveform including a plurality of drive pulses applied to the liquid discharge head; and applying the drive waveform to the liquid discharge head to discharge liquid, the drive waveform including a non-discharge pulse not to discharge the liquid and a discharge pulse to discharge the liquid, the non-discharge pulse and the discharge pulse being serial in time in the drive waveform, Td being in a range of Tc−0.2×Tc to Tc+0.45×Tc, and Vp1 being in a range of −10% to +10% of Vpp1, where Td represents a time interval between the non-discharge pulse and the discharge pulse, Tc represents a natural vibration period of a pressure chamber of the liquid discharge head, Vp1 represents a peak value of the non-discharge pulse, and Vpp1 represents a peak value of the non-discharge pulse at which a droplet speed of liquid discharged by the discharge pulse takes a local minimum value.

* * * * *